US008922319B2

(12) United States Patent
Yokota

(10) Patent No.: US 8,922,319 B2
(45) Date of Patent: Dec. 30, 2014

(54) REACTOR

(75) Inventor: Shuji Yokota, Nagoya (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 0 days.

(21) Appl. No.: 13/634,094

(22) PCT Filed: May 25, 2010

(86) PCT No.: PCT/JP2010/058791

§ 371 (c)(1),
(2), (4) Date: Sep. 11, 2012

(87) PCT Pub. No.: WO2011/148458

PCT Pub. Date: Dec. 1, 2011

(65) Prior Publication Data

US 2012/0326822 A1 Dec. 27, 2012

(51) Int. Cl.

| | |
|---|---|
| ***H01F 27/30*** | (2006.01) |
| ***H01F 17/06*** | (2006.01) |
| ***H01F 27/24*** | (2006.01) |
| ***H01F 27/26*** | (2006.01) |
| ***H01F 27/32*** | (2006.01) |
| *H01F 37/00* | (2006.01) |
| *H01F 27/255* | (2006.01) |
| *H01F 3/14* | (2006.01) |

(52) U.S. Cl.

CPC ..... *H01F 27/327* (2013.01); *H01F 37/00* (2013.01); *H01F 27/255* (2013.01); *H01F 27/306* (2013.01); *H01F 3/14* (2013.01)

USPC ..... 336/197; 336/178; 336/205; 336/209; 336/212; 336/210

(58) Field of Classification Search

USPC ..... 336/221, 233, 212, 178, 147, 205, 209, 336/210, 197

See application file for complete search history.

(56) References Cited

U.S. PATENT DOCUMENTS 4,334,206 A * 6/1982 Nakamura ..... 336/96
4,794,360 A * 12/1988 van Mensvoort ..... 336/178

(Continued)

FOREIGN PATENT DOCUMENTS

JP 07022258 A 1/1995
JP 2004-327569 A 11/2004

(Continued)

OTHER PUBLICATIONS

International Search Report of PCT/JP2010/058791 mailed Sep. 7, 2010.

*Primary Examiner* — Mangtin Lian
(74) *Attorney, Agent, or Firm* — Kenyon & Kenyon LLP

(57) ABSTRACT

A reactor includes: a molded coil including two coils integrally molded with resin; and two U-shaped cores each having core insertion portions inserted in the coils in a coil axial direction, and the cores being joined in a track-like form by interposing gap elements between them to form a core assembly. The molded coil has a substantially hexahedral shape, each of the cores includes a core outer portion joining the core insertion portions, a resin layer made of magnetic-metal containing resin consisting of binder resin and magnetic metal powder mixed therein is formed on outer surfaces of the core outer portions, the molded coil includes a fastening retaining part for holding and fixing the reactor to a cabinet with a fastening member so that the cabinet supports the reactor, and the molded coil is held apart from the cabinet by the fastening member and the fastening-member retaining part.

15 Claims, 16 Drawing Sheets

(56) References Cited

U.S. PATENT DOCUMENTS

| | | | | |
|---|---|---|---|---|
| 5,122,947 | A * | 6/1992 | Hishiki | 363/61 |
| 5,587,694 | A * | 12/1996 | Minato et al. | 336/65 |
| 6,600,402 | B1 * | 7/2003 | LaFleur et al. | 336/61 |
| 2009/0206973 | A1 * | 8/2009 | Yabumi et al. | 336/110 |
| 2009/0315663 | A1 * | 12/2009 | Kiyono et al. | 336/219 |
| 2010/0194516 | A1 * | 8/2010 | Sato et al. | 336/221 |

FOREIGN PATENT DOCUMENTS

| | | | |
|---|---|---|---|
| JP | 2006-352021 | A | 12/2006 |
| JP | 2007-081305 | A | 3/2007 |
| JP | 2007-180225 | A | 7/2007 |
| JP | 2007-250978 | A | 9/2007 |
| JP | 2008-042051 | A | 2/2008 |
| JP | 2009-026995 | A | 2/2009 |
| JP | 2009-059954 | A | 3/2009 |
| JP | 2009070884 | A | 4/2009 |
| JP | 2009-218294 | A | 9/2009 |
| JP | 2009-246221 | A | 10/2009 |
| JP | 2011-249427 | A | 12/2011 |
| WO | WO 2009/034710 | A1 * | 3/2009 |
| WO | 2011/161769 | A1 | 12/2011 |
| WO | 2011/161770 | A1 | 12/2011 |

* cited by examiner

REACTOR

CROSS-REFERENCE TO RELATED APPLICATIONS

This is a 371 national phase application of PCT/JP2010/058791 filed on May 25, 2010, the entire contents of which are incorporated herein by reference.

FIELD OF THE INVENTION

The present invention relates to a reactor and, more particularly, to a reactor in which two coils are arranged in parallel, two U-shaped cores are inserted in the coils from their both sides in a coil axial direction to face each other, and the cores are joined in a track-like form.

BACKGROUND OF THE INVENTION

Conventionally, a drive control system of a hybrid vehicle and others mounts therein such a reactor as disclosed in for example Patent Document 1 to increase the voltage of the system. FIG. 11 is a view to explain the reactor disclosed in Patent Document 1.

A reactor 110 of Patent Document 1 includes a coil 120 and cores 130 as shown in FIG. 11. When a state of current flowing in the coil 120 is changed, inductance is changed as magnetic flux density varies in a magnetic circuit generated in the cores 130, thus generating an electromotive force.

The conventional reactor structure such as the reactor 110 shown in Patent Document 1 will be explained below referring to FIGS. 12 to 14. FIG. 12 is an explanatory view of an example of the conventional reactor structure. FIG. 13 is a plan view of FIG. 12 seen from a side C, schematically showing a main part of the reactor shown in FIG. 12. FIG. 14 is a side view of FIG. 12 seen from a side D.

As shown in FIGS. 12 to 14, a reactor 210 is configured such that two coils 221 electrically connected in series, two U-shaped cores 230 are inserted in each coil 221 from their both ends in a coil axial direction (right upper-left lower direction in FIG. 12) to face each other, and the cores 230 are joined in a track-like form while interposing gap elements 235 therebetween.

Inside the wound coils 221, core insertion portions 230A on both sides of each core 230 are inserted to extend along the coils 221 while keeping constant clearance with respect to the coils 221. At coil ends on both sides of each coil 221 in its axial direction (upper and lower sides in FIG. 13 and left and right sides in FIG. 14), the coils 221 and the cores 230 do not face each other in the coil axial direction.

In the reactor 210, the cores 230 and thin plates are integrally formed. The thin plates are partially bent and deformed into stays 225 located at four positions near both coil ends of the coils 221. By inserting bolts in through holes 225H of the stays 225, the reactor 210 is positioned and fixed to a cabinet not shown with the bolts.

RELATED ART DOCUMENTS

Patent Documents

Patent Document 1: JP-A-2007-180225

SUMMARY OF INVENTION

Problems to be Solved by the Invention

However, the conventional reactor as in Patent Document 1 has the following two disadvantages.

(1) Problem with increased-size core (2) Problem with difficulty in forming reduced-size core These problems are caused by the following reasons.

(1) Problem with Increased-Size Core

FIG. 15 is a schematic diagram showing magnetic paths in a magnetic circuit of the conventional reactor to explain a relationship between the magnetic paths and magnetic saturation. In a reactor, a magnetic field is generated around a coil, including a core main body inside a wound coil, a clearance between the coil and the core, and a portion near the coil ends of the coil and adjacent to the coil in a coil axial direction.

On the other hand, for reactor characteristics, when current flowing in the coil is increased, the magnetic flux density is also increased. When the intensity of the magnetic field becomes constant, magnetic saturation occurs. As a current value increases, usually, the magnetic flux density is increased gradually as indicated by magnetic line paths MR, from a short magnetic path (a thickest arrow) to a long magnetic path (a thinnest arrow), as shown in FIG. 15.

In the cores 230 of the conventional reactor 210, the core insertion portions 230A inserted in the coils 221 and the core outer portions 230B each joining the core insertion portions 230A outside the coils 221 are located in the magnetic field and utilized as a magnetic circuit.

In these cores 230, however, the core outer portions 230B are not present in positions adjacent to the coil ends of the coils 221 in the coil axial direction as shown in FIGS. 13 and 14. A magnetic field in portions E (hereinafter, simply referred to as "coil-end adjacent portions") near the coil ends of the coils 221 and adjacent to the coils 221 in the coil axial direction also originally belong to a range usable as a magnetic circuit. However, the coil-end adjacent portions E are dead space as shown in FIGS. 14 and 15.

In the case where the coil-end adjacent portions E are dead space, long magnetic paths are less in the magnetic circuit during operation of the reactor. Thus, even when the current flowing in the coils is increased, magnetic saturation occurs at a low current value and the voltage could not be increased up to a desired voltage value.

To avoid such a phenomenon, the reactor 210 is arranged as shown in FIG. 15 such that the U-shaped cores 230 each have a long circumferential length (entire length) and a wide cross sectional area to increase the volume of each entire core 230. This ensures long paths Rm in the magnetic paths MR so that the voltage could be increased up to the desired voltage value before magnetic saturation occurs.

However, since the reactor 210 consists of two U-shaped cores 230 joined in a track-like form while interposing the gap elements 235 therebetween, increasing the size of one of the cores 230 results in increased-size of the entire reactor 210. This is a problem with a space.

(2) Problem with Difficulty in Forming Reduced-Size Core

Cores are roughly classified into a laminated-steel-plate core made of a plurality of laminated thin steel plates and a powder core made of magnetic metal powder compressed into an integral form.

To solve the above problem (1), the present applicant studied that the coil-end adjacent portions E which are dead space are also used for the magnetic circuit to reduce the entire size of the cores 230 in both cases; the laminated-steel-plate core and the powder core. FIG. 16 is a perspective view showing a core of a reactor in a referential example studied for the powder core.

Firstly, the shape of the studied core is explained.

Each core 230 is formed in a U-like shape as shown in FIGS. 13 and 14 including core insertion portions 230A on both sides that are inserted in the coils 221. When a portion corresponding to the coil-end adjacent portion E which would be dead space outside the coils 221 is to be used as a part of the outer portion of a core 332 as shown in FIG. 16, a core 330 has to have a three-dimensional (3D) shape in which steps R1 and R2 are generated between reference surfaces P1 and P2 of each core insertion portion 331 and reference surfaces G1 and G2 of the core outer portion 332.

In contrast, in the case of the laminated-steel-plate core, it is technically difficult to form the aforementioned 3D-shaped core 330 by laminating a plurality of thin steel plates as shown in FIG. 16 by a general system used for forming the conventional laminated-steel-plate core. Even if such a 3D-shaped laminated-steel-plate core 330 can be manufactured by use of a special dedicated system, it needs high costs. Thus, actual manufacturing of the laminated-steel-plate core including the coil-end adjacent portions as part of the magnetic circuit is very difficult.

On the other hand, the powder magnetic core is costless as compared with the laminated-steel-plate core and therefore is used as many cores. Accordingly, the applicant also studied forming the powder core as a 3D-shaped core 330 having steps R1 and R2 between core insertion portions 331 and core outer portions 332 according to a mold-clamping method that is flexible to a certain degree as with the conventional forming method of powder core.

Specifically, the studied cores 330 each include core insertion portions 331, 331 inserted in two coils from their both sides in the coil axial direction as shown in FIG. 16, and a core outer portion 332 joining the core insertion portions 331, 331 at respective one sides and located in the coil-end adjacent portions (sections E in FIG. 14). This core 330 is entirely integrally made of compressed powder.

However, investigating the formed core 330 revealed that the core outer portions 332, particularly, corner portions 332C did not have desired mechanical strength, and thus it was difficult to form the core 330 of compressed powder by use of a general system for forming a powder core. One of the reasons is conceivably in that a pressing force by mold clamping is not uniformly transmitted to the corners 332C with respect to the compressed powder to be compressed, and metal powders are not pressed by sufficient joining force at the corners 332C.

Therefore, the applicant has also studied forming the core 330 by using the special molding system so as to increase the mechanical strength of the corners 332C to a desired level, but also found that the core 330 made of the compressed powder resulted in a high cost.

In the conventional reactor, as mentioned above, the applicant studied both cases for the laminated-steel-plate core and the powder core to reduce the entire size of a core by using the coil-end adjacent portions which would be dead space as the magnetic circuit. However, any cases have technical difficulties in forming the 3D-shaped core 330 having the steps R1 and R2 between the reference surfaces P1 and P2 of the core insertion portions 331 and the reference surfaces G1 and G2 of the core outer portions 332 as shown in FIG. 16.

The present invention has been made to solve the above problems and has a purpose to provide a reactor having an entirely reduced size than a conventional reactor while keeping performances.

Means of Solving the Problems

To achieve the above purpose, one aspect of the invention provides a reactor configured as below.

(1) A reactor includes: a molded coil in which two coils electrically connected in series are arranged in parallel and integrally molded with resin covering a radial outside of the coils; and two U-shaped cores each having core insertion portions on both sides, the core insertion portions of the cores being inserted in the coils from either sides of the coils in a coil axial direction to face each other, and the cores being joined in a track-like form by interposing gap elements between them to form a core assembly, wherein the molded coil has a substantially hexahedral shape, each of the cores includes a core outer portion joining, outside the coils, both the core insertion portions inserted in the coils, a magnetic-metal containing resin layer made of magnetic-metal containing resin consisting of binder resin and magnetic metal powder mixed therein is formed on outer surfaces of the core outer portions, the molded coil includes a fastening retaining part for holding and fixing the reactor to a cabinet with a fastening member so that the cabinet supports the reactor, and the molded coil is held apart from the cabinet by the fastening member and the fastening-member retaining part.

(2) In the reactor in (1), preferably, the magnetic-metal containing resin layer is formed at least on a part of each core outer portion in a position on coil ends of each coil located on both ends in the coil axial direction, the position located on the outside of each of the coils in a coil axial direction.

(3) In the reactor in (1) or (2), preferably, each core is designed so that the core insertion portions and the core outer portion are formed with the same height, while a cross sectional area of the core outer portion is smaller than a cross sectional area of each core insertion portion.

(4) In the reactor in one of (1) to (3), preferably, the binder resin of the magnetic-metal containing resin is epoxy resin.

(5) In the reactor in (4), preferably, the magnetic-metal containing resin covers the core insertion portions of each core.

(6) In the reactor in one of (1) to (3), preferably, the binder resin of the magnetic-metal containing resin is thermoplastic resin.

(7) In the reactor in (1), preferably, the fastening-member retaining part is provided at the center in a thickness direction of the molded coil in the coil axial direction.

(8) In the reactor in (7), preferably, the fastening-member retaining part is a reactor retainer extending to stride over the molded coil in a coil radial direction and including a through hole in a position outside of the covered molded coil, and the fastening member is inserted through the through hole of the reactor retainer and secured to the cabinet.

(9) In the reactor in (8), preferably, the reactor retainer is made of metal and integral with the molded coil by insert molding.

The operations and advantageous effects of the present invention having the above configurations will be explained below.

(1) In the above configured reactor, the molded coil has a substantially hexahedral shape, each of the cores includes a core outer portion joining, outside the coils, both the core insertion portions inserted in the coils, and a magnetic-metal containing resin layer made of magnetic-metal containing resin consisting of binder resin and magnetic metal powder mixed therein is formed on outer surfaces of the core outer portions. Accordingly, the magnetic field in the core insertion portions of the cores located on the radial inside of the coils and in the core outer portions of the cores located on the outside of the coils can be utilized as the magnetic circuit. In addition, a magnetic field in a portion ("coil-end adjacent portion") near the coil ends and adjacent to the coils in the coil axial direction can also be effectively utilized as the magnetic circuit because of the presence of the magnetic-metal containing resin layers.

Specifically, the metal powder contained in the magnetic-metal containing resin is for example ferrite metal mainly containing Fe, metals such as Zn and Mn, or Fe-base alloy such as Fe—C alloy and Fe—Si alloy, and others. The powder has a particle diameter of several μm to several tens of μm. Such metal powder is contained in the magnetic-metal containing resin by as much as about 90%, for example, at a ratio by weight to the binder resin. The magnetic-metal containing resin layers made of the magnetic-metal containing resin on the outer surfaces of the core outer portions are inferior in magnetic permeability to the powder core, but can function as a core to generate the magnetic circuit.

Accordingly, during operation of the reactor, the magnetic-metal containing resin layers are also located in the magnetic field generated in the coil-end adjacent portions. Thus, not only the cores but also the magnetic-metal containing resin layers formed on the outer surfaces of the core outer portions can be effectively utilized for the magnetic circuit.

When the magnetic circuit corresponding to the volume equal to the conventional cores is to be generated by the aforementioned cores and the magnetic-metal containing resin layers, the cores can be reduced in size than the conventional cores by an amount almost corresponding to the volume of the magnetic-metal containing resin layers.

Furthermore, the reactor configured such that both the core insertion portions of each core are inserted in the coils from one sides of the coils in the coil axial direction to face each other and joined in a track-like form by interposing the gap elements between them can provide a superior advantage of a reduced size than the conventional reactor while keeping the performance of the conventional reactor.

(2) In the above configured reactor, the magnetic-metal containing resin layer is formed at least on a part of each core outer portion in a position on coil ends of each coil located on both ends in the coil axial direction, the position located on the outside of each of the coils in the coil axial direction. Accordingly, since the magnetic-metal containing resin protects the outer surfaces of the core outer portions, at least the portions of the cores protected with the magnetic-metal containing resin can be prevented from suffering damages such as breaking and cracking and also rust.

Since the magnetic-metal containing resin layers made of the magnetic-metal containing resin are formed on the outer surfaces of the core outer portions, regardless of which the cores are laminated-steel-plate cores or powder cores, the core (core assembly) capable of effectively utilizing the magnetic field located in the coil-end adjacent portions as a part of the magnetic circuit can be achieved at lower costs owing to the cores and the magnetic-metal containing resin layers.

In the case of the laminated-steel-plate cores, conventionally, it is considerably difficult in technique to manufacture a 3D-shaped core made of a plurality of laminated thin steel plates having steps between core insertion portions and core outer portions as shown in FIG. 16. This leads to cost increase. A core utilizing a coil-end adjacent portion as a part of a magnetic circuit could not be easily attained.

In contrast, in the reactor configured as above, the laminated-steel-plate cores can also be manufactured in a similar manner to the manufacturing method of the conventional laminated-steel-plate cores. In addition, the magnetic-metal containing resin layers can be formed on a steel plate constituting the cores by known methods, for example, a fixing method using an adhesive material and a method of integrally forming magnetic-metal containing resin and the cores by injection molding.

According to the above reactor, therefore, even when the cores are the laminated-steel-plate cores, a core (core assembly) capable of effectively utilizing the magnetic field located in the coil-end adjacent portion as a part of the magnetic circuit can be manufactured by the cores and the magnetic-metal containing resin layers at low costs.

On the other hand, in the case of the powder cores, when the 3D-shaped core having the steps between the core insertion portions and the core outer portions as shown in FIG. 16 is manufactured by the forming method similar to the forming method of the conventional powder cores, the core outer portions, particularly, the corner portions are apt to be lower in mechanical strength than a desired level. Furthermore, a study was also made on forming a core by using a special forming system to provide the desired mechanical strength to the corner portions. This rather results in a problem with high cost.

In contrast, according to the reactor configured as above, the cores can be manufactured by the same forming method as the forming method of the conventional powder cores. In addition, by for example a fixing method using an adhesive material, a method of integrally forming magnetic-metal containing resin and cores by injection molding, and other methods, the core outer portions and the magnetic-metal containing resin layers of the formed cores can be made integrally tightly contact with each other. Accordingly, the coil-end adjacent portions which would be dead space in the conventional cores can also be utilized easily as a part of the magnetic circuit.

According to the reactor configured as above, therefore, even when the cores are the powder cores, a core assembly capable of effectively utilizing the magnetic field located in the coil-end adjacent portions as a part of the magnetic circuit can be produced by the cores and the magnetic-metal containing resin layers at low costs.

In addition, even though the cores are constituted of powder cores and the magnetic-metal containing resin layers are formed in the coil-end adjacent portions, the cores can be designed to be smaller than the conventional cores. Thus, the reactor configured as above can be manufactured without causing cost increase.

(3) In the above configured reactor, each core is designed so that the core insertion portions and the core outer portion are formed with the same height, while a cross sectional area of the core outer portion is smaller than a cross sectional area of each core insertion portion. Accordingly, the total length of the reactor configured as above can be shorter in the coil axial direction than the conventional reactor. Thus, in the case where the reactor configured as above is manufactured by the same specifications in reactor performance as those of the conventional reactor, the above reactor can be more compact than the conventional reactor, so that the reactor can be installed in a narrower space than conventional.

In particular, when the reactor configured as above is mounted in a drive control system such as a hybrid vehicle, an electric car, or the like to increase the voltage of the system, a size-reduced reactor is less restricted in space for installation. The reactors having the same specifications can be mounted in many kinds of vehicles. This enables mass production of the reactors configured as above with the same specifications, leading to low cost of the reactors.

(4) In the above configured reactor, the binder resin of the magnetic-metal containing resin is epoxy resin. Since the epoxy resin has an adhesive property to join separate elements to each other, even if the metal powder is contained in the magnetic-metal containing resin by as much as about 90% at a ratio by weight, metal powder particles can be integrally bonded to each other through binder resin.

When a large amount of metal powder can be contained in the magnetic-metal containing resin because the binder resin is epoxy resin, the metal powder has a high thermal conductivity and hence the entire magnetic-metal containing resin has a high thermal conductivity. During operation of the reactor, therefore, the heat generated in the coils in the molded coil is easy to transfer to the magnetic-metal containing resin having a high thermal conductivity and thus efficiently be released from the magnetic-metal containing resin to the outside.

(5) In the above configured reactor, the magnetic-metal containing resin covers the core insertion portions of the cores. In the manufacturing process of the reactor configured as above, accordingly, when the cores are joined to each other while the gap elements are interposed between them, the epoxy resin contained in the magnetic-metal containing resin can be utilized as an adhesive to bond the cores and the gap elements.

In the reactor, specifically, the two U-shaped cores are inserted in the coils from both sides of the coils to face each other and joined in a track-like form. In general, the gap elements having a lower magnetic permeability than the cores are interposed between the opposite core insertion portions.

In the manufacturing process of the conventional reactor, when the cores are to be joined by interposing the gap elements between them to form a core (core assembly), the cores and the gap elements are fixed to each other by additionally using an adhesive in a bonding oven in a bonding step. In the aforementioned reactor, in contrast, such a bonding oven is unnecessary and the gap elements and the core insertion portions of the cores can be joined in close contact relation by the magnetic-metal containing resin covering the core insertion portions of the cores.

When the magnetic-metal containing resin is to be formed on the core outer portions, the core insertion portions are also covered by the magnetic-metal containing resin for protective measures of the core outer portions, the cores entirely protected by the magnetic-metal containing resin can prevent the occurrence of damages such as breaking and cracking, and the occurrence of rust.

In addition, this protective measure of the cores can be implemented simultaneously when the magnetic-metal containing resin layers are formed on the outer surfaces and of the core outer portions. Accordingly, the productivity for the protective measures of the cores can be improved as compared with the conventional protective measures, resulting in reduced costs of the protective measures of the cores.

(6) In the above configured reactor, the binder resin of the magnetic-metal containing resin is thermoplastic resin. Accordingly, a process of forming the magnetic-metal containing resin layers on the outer surfaces of the core outer portions, a process of covering the core insertion portions with the magnetic-metal containing resin, and other processes can be implemented at high cycles.

Therefore, the productivity associated with forming the magnetic-metal containing resin layers and covering the core insertion portions with the magnetic-metal containing resin can be enhanced. The cost of the above configured reactor can be reduced. The thermoplastic resin may include polyphenylene sulfide (PPS), polyamide resin which is a material forming nylon, polyamide, etc., and the like.

(7) In the above configured reactor, the molded coil includes a fastening-member retaining part for holding and fixing the reactor to a cabinet with a fastening member so that the cabinet supports the reactor. Accordingly, even when the cores are vibrated during operation of the reactor and this vibration is transmitted to the molded coil which is not a vibration source, transmission of vibration can be reduced in the resin molded layer of the molded coil.

When the state of current flowing in the coils changes during operation of the reactor, the electromagnetic suction force acting between the cores depending on changes in magnetic flux density and the magnetostriction occurring in each core are generated, thereby causing expansion and contraction of both the cores, resulting in vibration of the cores.

In the reactor configured as above, the molded coil which is not a vibration source of such vibration is provided with the fastening-member retaining part. Accordingly, even when the vibration of the cores is transmitted to the molded coil, the reactor can be fixed to the cabinet while vibration transmission is reduced in the molded layer of the molded coil.

(8) In the above configured reactor, the fastening-member retaining part is provided at the center in a thickness direction of the molded coil in the coil axial direction. The reactor is held on the cabinet by use of the retaining part provided in that position and fixed with the fastening member. Accordingly, even if vibration of the cores during operation of the reactor is transmitted to the cabinet through the molded coil and the fastening members, vibration to be transmitted to the cabinet can be reduced.

During operation of the reactor, specifically, the cores expand and contract and thus vibrate as mentioned above. Cores are roughly classified into a laminated-steel-plate core made of a plurality of laminated thin steel plates and a powder core made of compressed powder. The powder core is lower in cost than the laminated-steel-plate core and therefore frequently used for cores.

On the other hand, comparing mechanical properties between the laminated-steel-plate core and the powder core, Young's modulus of the powder core is smaller than that of the laminated-steel-plate core and resonance frequency of the powder core is lower than that of the laminated-steel-plate core.

In the case where the core is the laminated-steel-plate core, the resonance frequency of the laminated-steel-plate core is different by several KHz or more from the drive frequency (about 10 KHz) at which the core vibrates during operation of the reactor. Thus, the core is less likely to largely vibrate under the influence of the resonance frequency.

In the case of the powder core, in contrast, the drive frequency of the core is close to the resonance frequency of the powder core and thus the core is likely to largely vibrate.

Irrespective of which the cores are the powder cores or the laminated-steel-plate cores, the vibration of the cores is mostly the vibration (axial vibration) of the cores repeatedly expanding and contracting in a direction to face each other. This vibration includes an "anti-node" representing a maximum amplitude and a "node" representing a minimum amplitude.

In the case where the cores are the powder cores, particularly, when the cores vibrates at the drive frequency close to the resonance frequency, the large vibration of the cores is transmitted to the cabinet fixed to the reactor with the fastening member at a position corresponding to the maximum amplitude, "anti-node". This causes noise resulting from the vibration of the cores.

In contrast, in the above configured reactor, the center in the thickness direction of the molded coil coincides with the position corresponding to the node of the vibration during axial vibration of the two cores. In this position, the magnetostriction and the amplitude of the vibration by the electromagnetic attraction force in the two cores are minimum.

In the case where the cores are low-cost powder cores as, the vibration of the cores has a minimum amplitude in the center in the thickness direction of the molded coil even when the drive frequency of the cores is close to the resonance frequency of the cores.

Therefore, the reactor is fixedly held on the cabinet by use of the fastening member and the fastening-member retaining part placed in the center in the thickness direction of the molded coil. Even if the vibration is transmitted from the cores to the cabinet through the molded coil and the fastening member, the vibration of the cores transmitted to the cabinet can be reduced.

Furthermore, transmission of the vibration of the cores occurring during operation of the reactor can be reduced. Thus, noise resulting from the vibration can be more reliably restrained.

(9) In the above configured reactor, the fastening-member retaining part is a reactor retainer extending to stride over the molded coil in the coil radial direction and including a through hole in a position outside of the covered molded coil, and the fastening member is inserted through the through hole of the reactor retainer and secured to the cabinet. Accordingly, during operation of the reactor, it is possible to reduce the vibration to be transmitted from the cores to the cabinet via the reactor retainer and the fastening member. This restrains loosening of the fastening member secured to the cabinet which may be caused by the transmission of vibration. Thus, the reactor can be tightly fixed to the cabinet with stable fastening force for a long term.

(10) In the above configured reactor, the reactor retainer is made of metal and integral with the molded coil by insert molding. Accordingly, the heat generated in the coils located inside the molded coil is easy to transfer to the reactor retainer having a thermal conductivity via the molded layer of the molded coil. This heat can be efficiently released from the reactor retainer to the outside.

Effects of the Invention

According to the invention, a reactor of entirely more reduced size than a conventional reactor can be achieved while keeping its performances.

DETAILED DESCRIPTION

A detailed description of Examples 1 and 2 of a reactor embodying the present invention will now be given referring to the accompanying drawings. A reactor of Examples 1 and 2 is mounted in a drive control system of a hybrid vehicle in order to increase a voltage value supplied from a battery to a voltage value to be applied to a motor generator. Therefore, the configuration of the drive control system is first explained and thereafter the reactor of Examples is described below.

Figure 9:
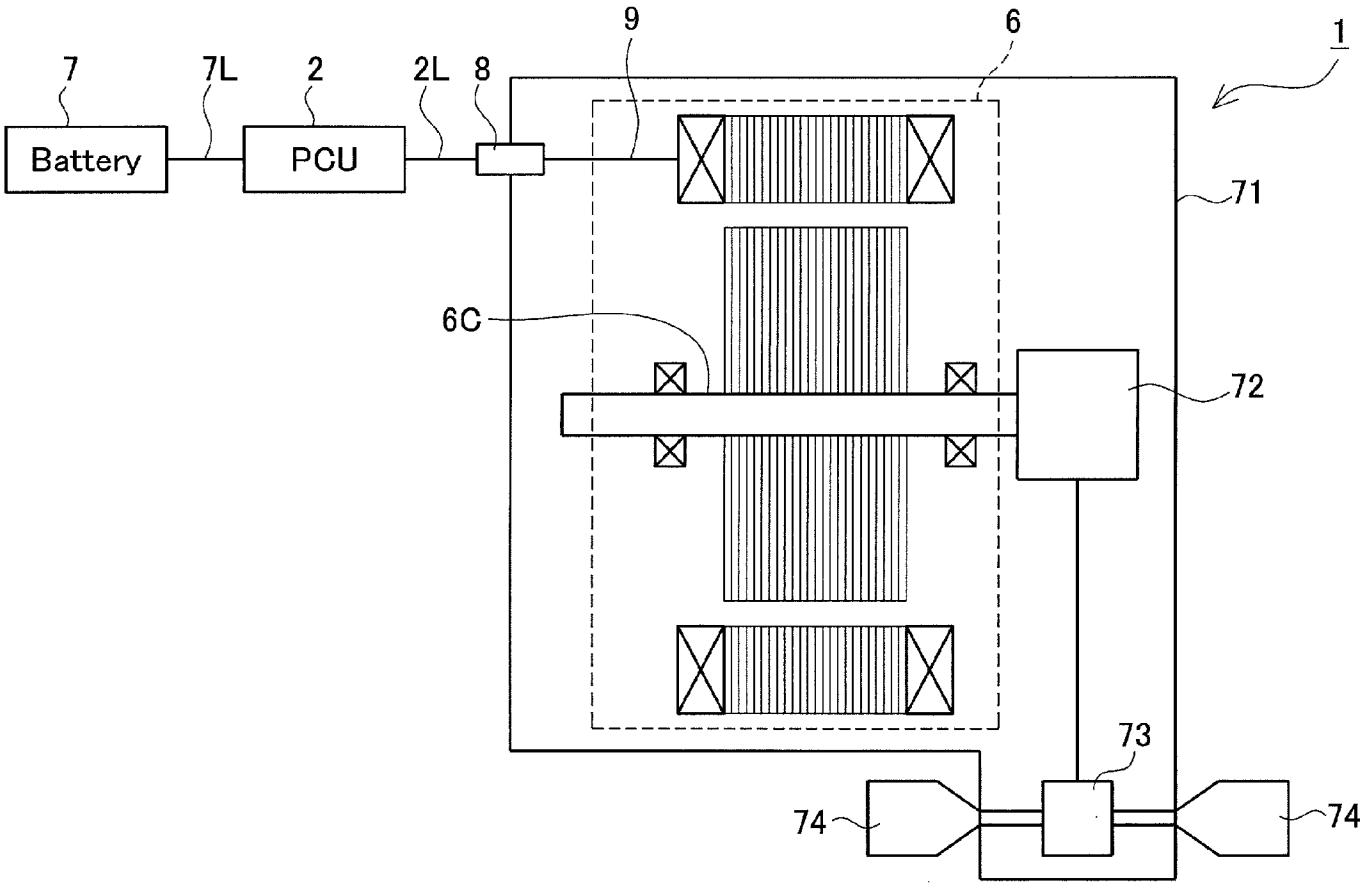
FIG. 9 is a block diagram schematically showing one example of a drive control system including the reactor of Examples 1 and 2.
Figure 10:
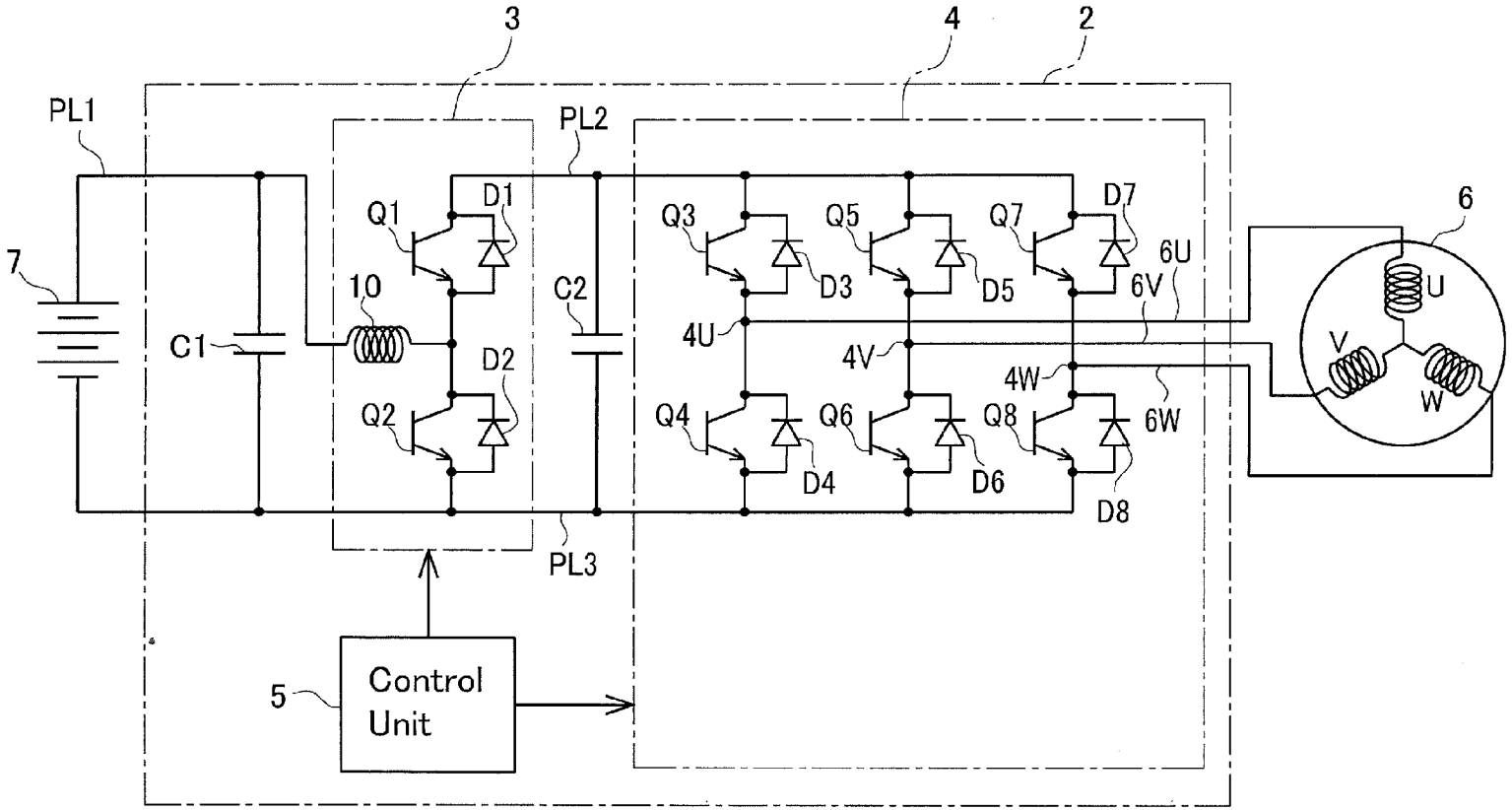
FIG. 10 is a circuit diagram showing a main part of PCU in FIG. 9.
Figure 11:
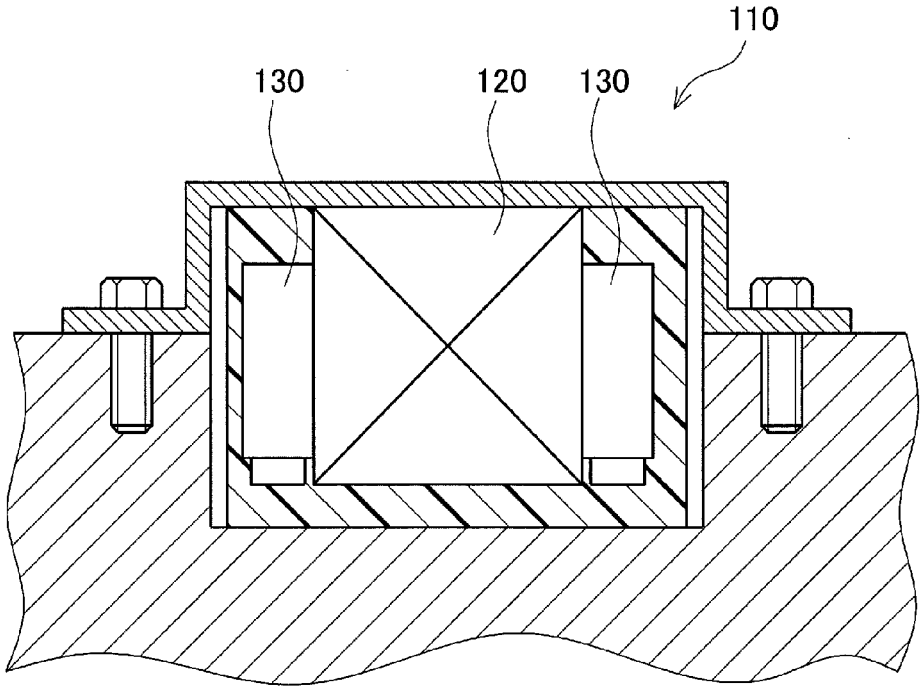
FIG. 11 is an explanatory view to explain a fixing structure of the reactor disclosed in Patent Document 1.
Figure 12:
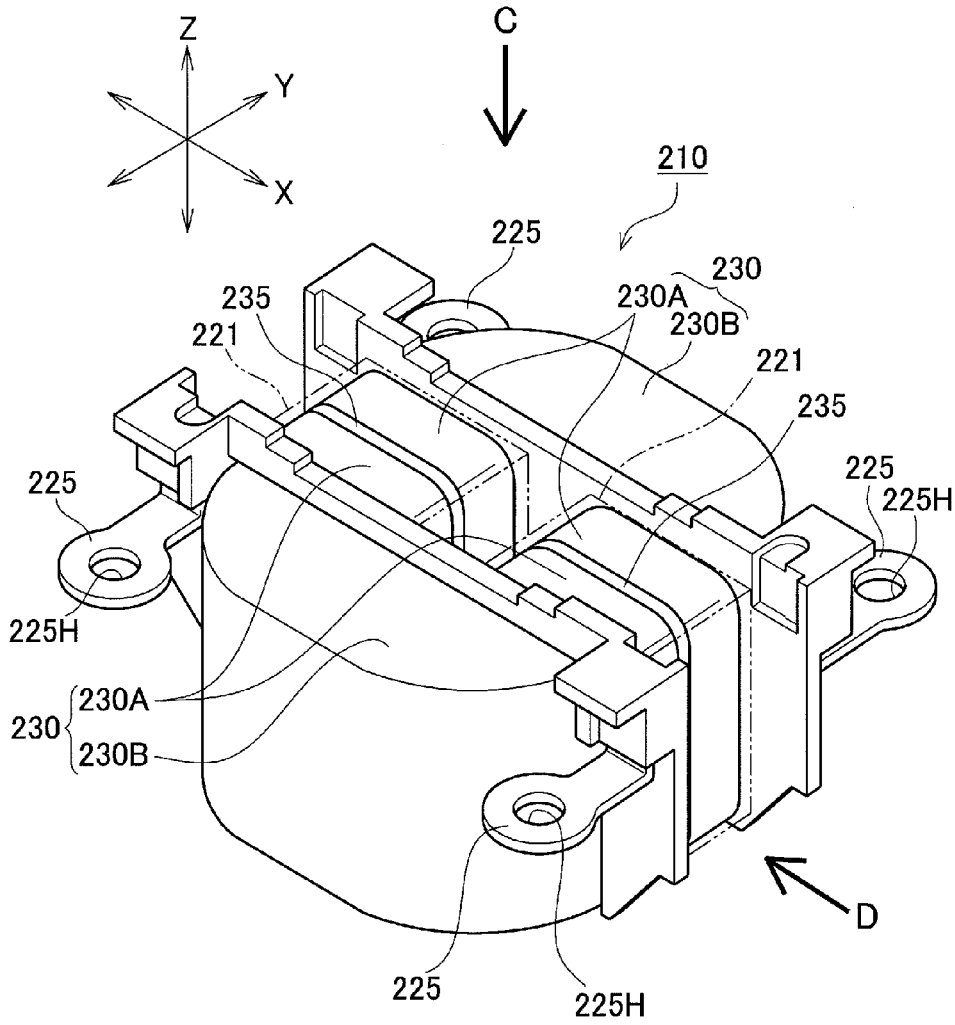
FIG. 12 is an explanatory view showing one example of a conventional reactor.

The drive control system is first explained referring to FIGS. 9 and 10. FIG. 9 is a block diagram schematically showing one example of a configuration of the drive control system including a reactor of Examples 1 and 2. FIG. 10 is a circuit diagram showing a main part of a PCU in FIG. 9. The drive control system 1 includes, as shown in FIG. 9, a PCU (Power Control Unit) 2, a motor generator 6, a battery 7, a terminal block 8, a housing 71, a decelerating mechanism 72, a differential mechanism 73, drive shaft supporting parts 74, and others.

The PCU 2 is explained below referring to FIG. 10. The PCU 2 includes, as shown in FIG. 10, a converter 3, an inverter 4, a control unit 5, condensers C1 and C2, and output lines 6U, 6V, and 6W. The converter 3 is coupled between the battery 7 and the inverter 4 and electrically connected in parallel to the inverter 4. The inverter 4 is connected to the motor generator 6 through the output lines 6U, 6V, and 6W.

The battery 7 is a secondary battery such as nickel-metal hydride battery and a lithium ion battery. The battery 7 supplies direct current to the converter 3 and is charged with the direct current flowing from the converter 3. The converter 3 includes power transistors Q1 and Q2, diodes D1 and D2, and a reactor 10 which will be described later. The power transistors Q1 and Q2 are connected in series between power-supply lines PL2 and PL3 to supply control signals of the control unit 5 to a base. The diodes D1 and D2 are each connected between a collector and an emitter of each of the power transistors Q1 and Q2 to allow current to flow from the emitter to the collector of the corresponding power transistor Q1, Q2. The reactor 10 is placed so that its one end is connected to the power-supply line PL1 connected to a positive electrode of the battery 7 and the other end is connected to connecting points of the power transistors Q1 and Q2. The converter 3 is configured so that the reactor 10 increases DC voltage of the battery 7 and then the increased DC voltage is supplied to the power-supply line PL2. The converter 3 is also configured to decrease DC voltage from the inverter 4 and the decreased DC voltage is charged to the battery 7.

The inverter 4 includes a U-phase arm 4U, a V-phase arm 4V, and a W-phase arm 4W. The U-, V-, and W-phase arms 4U, 4V, and 4W are connected in parallel between the power-supply lines PL2 and PL3. The U-phase arm 4U includes power transistors Q3 and Q4 connected in series, the V-phase arm 4V includes power transistors Q5 and Q6 connected in series, and the W-phase arm 4W includes power transistors Q7 and Q8 connected in series. The diodes D3 to D8 are connected individually between a collector and an emitter of each power transistor Q3 to Q8 to allow current to flow from the emitter to the collector in each power transistor Q3 to Q8. Connecting points of the power transistors Q3 to Q8 of the arms 4U, 4V, and 4W are connected respectively to opposite neutral point sides of the U phase, V phase, and W phase of the motor generator 6 through the output lines 6U, 6V, and 6W.

This inverter 4 converts direct current flowing in the power-supply line PL2 to alternating current based on the control signal of the control unit 5 and then outputs the alternating current to the motor generator 6. Furthermore, the inverter 4 rectifies alternating current generated in the motor generator 6 to convert it to direct current, and then supplies the converted direct current to the power-supply line PL2. The condenser C1 is connected between the power-supply lines PL1 and PL3 to smooth a voltage level in the power-supply line PL1. The condenser C2 is connected between the power-supply lines PL2 and PL3 to smooth a voltage level in the power-supply line PL2.

The control unit 5 calculates a coil voltage in the U phase, V phase, and W phase of the motor generator 6 based on a rotation angle of a rotor of the motor generator 6, a motor torque command value, current values in the U phase, V phase, and W phase of the motor generator 6, and input voltage of the inverter 4. The control unit 5 generates PWM (Pulse Width Modulation) to turn on/off the power transistors Q3 to Q8 based on the calculation result and outputs the PWM to the inverter 4.

To optimize the input voltage of the inverter 4, the control unit 5 calculates a duty ratio of the power transistors Q1 and Q2 based on the aforementioned motor torque command value and the number of motor rotations. Based on this calculation result, the control unit 5 generates a PWM signal to turn on/off the power transistors Q1 and Q2 and outputs this signal to the converter 3. Furthermore, the control unit 5 controls switching operations of the power transistors Q1 to Q8 in the converter 3 and the inverter 4 to convert the alternating current generated in the motor generator 6 to direct current to thereby charge the battery 7.

In the PCU 2 configured as above, the converter 3 increases the voltage of the battery 7 based on the control signal of the control unit 5 and then applies the increased voltage to the power-supply line PL2. The condenser C1 smoothes the voltage to be applied to the power-supply line PL2. The inverter 4 converts the direct current smoothed by the condenser C1 to alternating current and outputs this alternating current to the motor generator 6. On the other hand, the inverter 4 converts alternating voltage generated by regeneration of the motor generator 6 to direct voltage and outputs the direct voltage to the power-supply line PL2. The condenser C2 smoothes the voltage to be applied to the power-supply line PL2. The converter 3 decreases the direct voltage smoothed by the condenser C2 and charges the battery 7.

EXAMPLE 1

Figure 1:
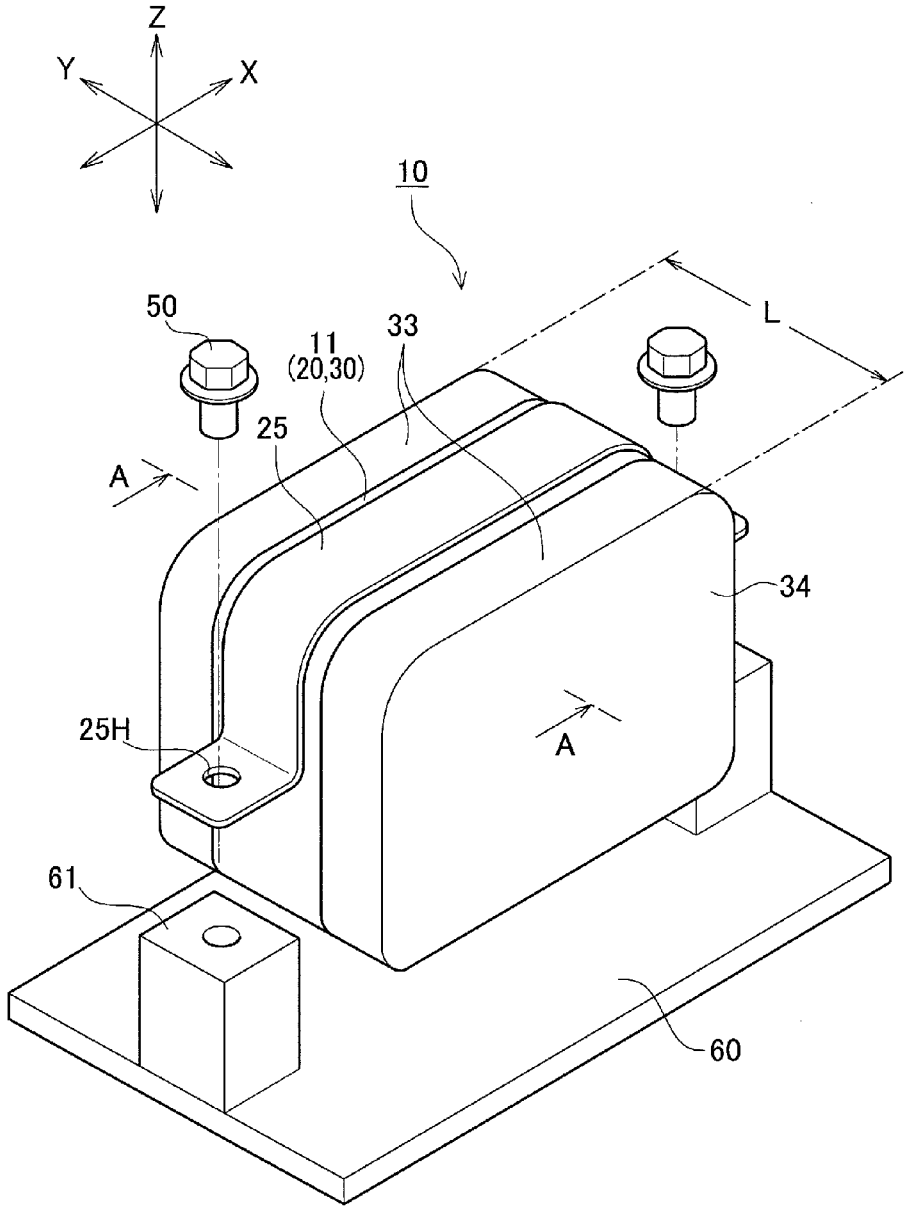
FIG. 1 is a perspective view showing a reactor of Examples 1 and 2.
Figure 2:
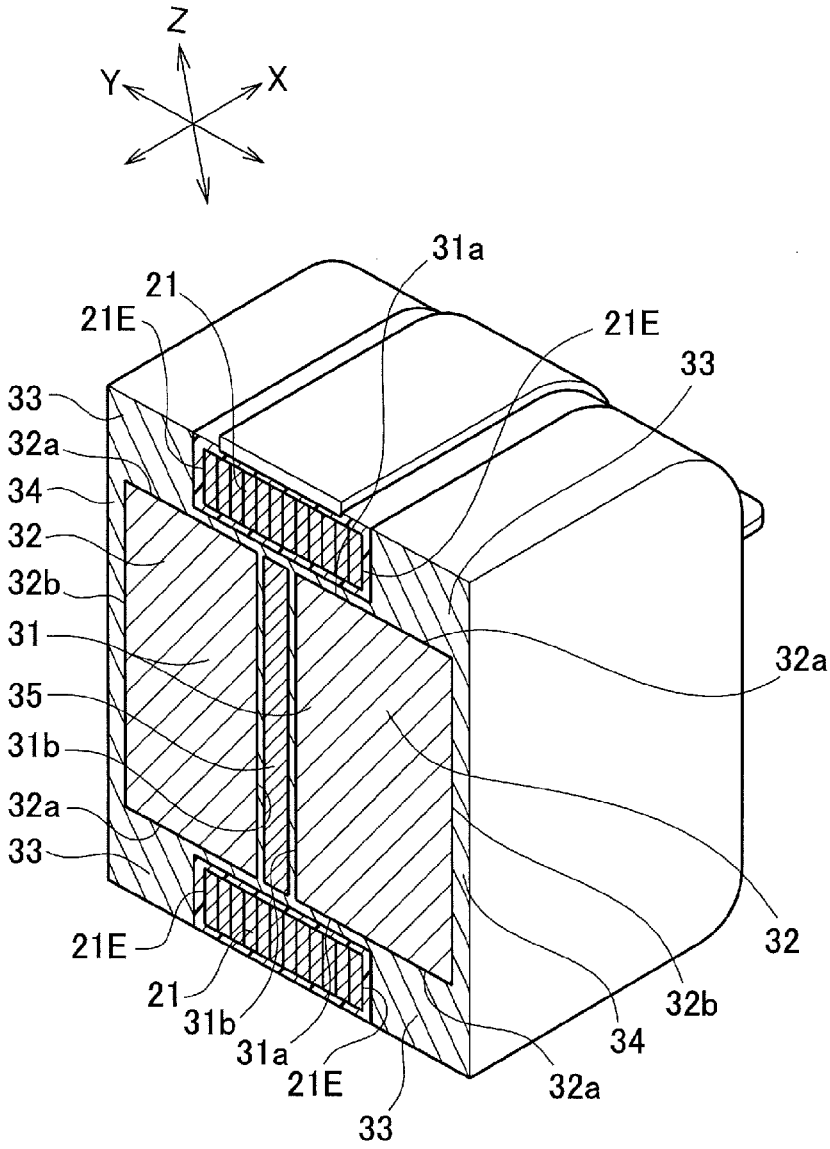
FIG. 2 is a cross sectional view taken along a line A-A in FIG. 1.
Figure 3:
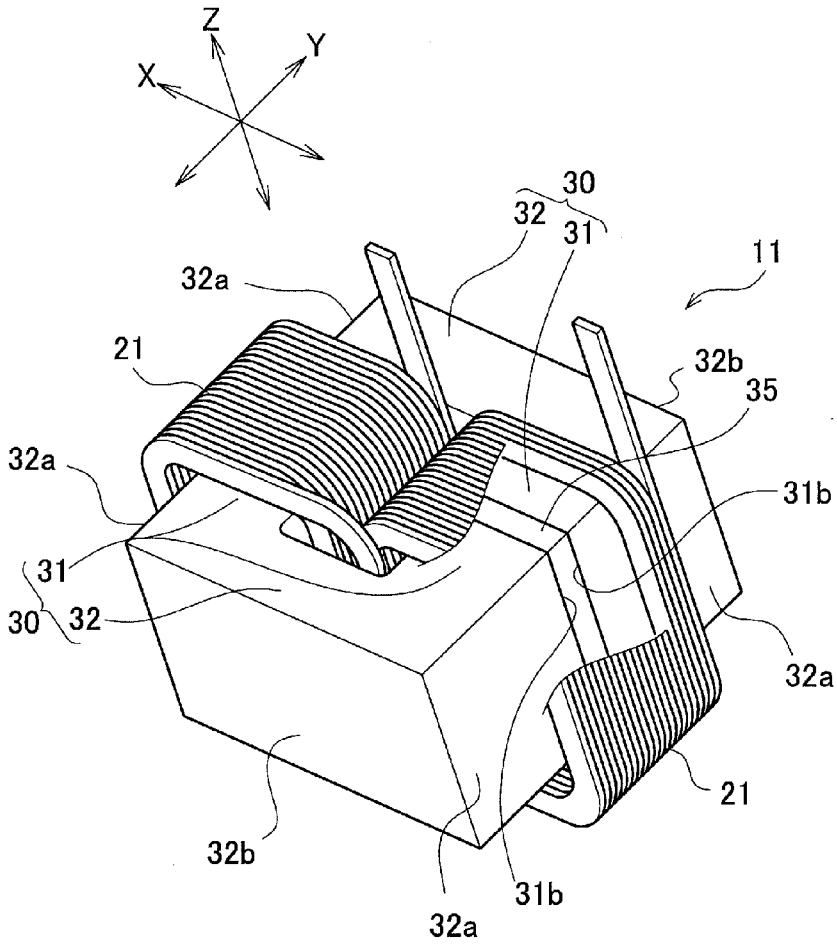
FIG. 3 is a perspective view of a main part of the reactor of Examples 1 and 2, showing a state where a molded layer is omitted.
Figure 4:
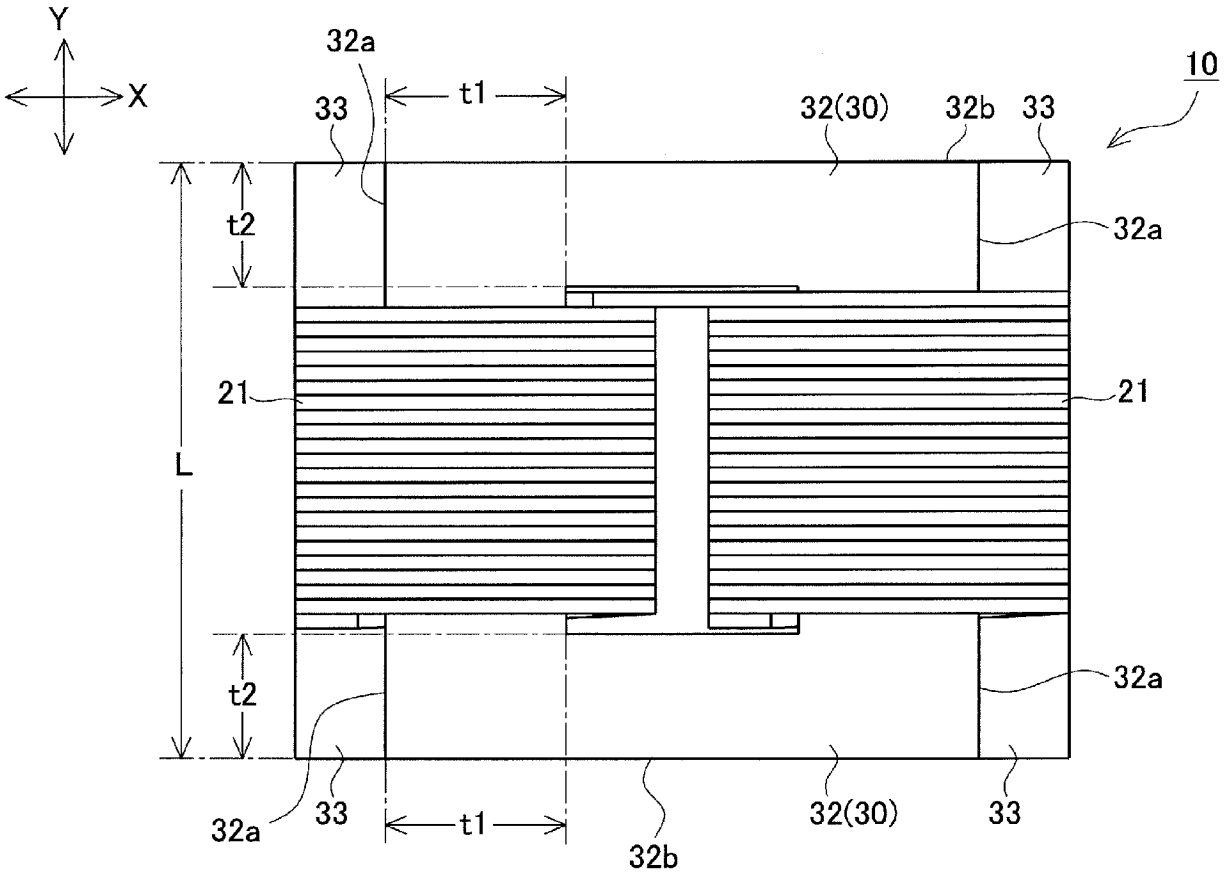
FIG. 4 is a plan view of the main part of the reactor shown in FIG. 3, seen from a direction Z, showing a state where a portion of magnetic-metal containing resin is omitted.
Figure 5:
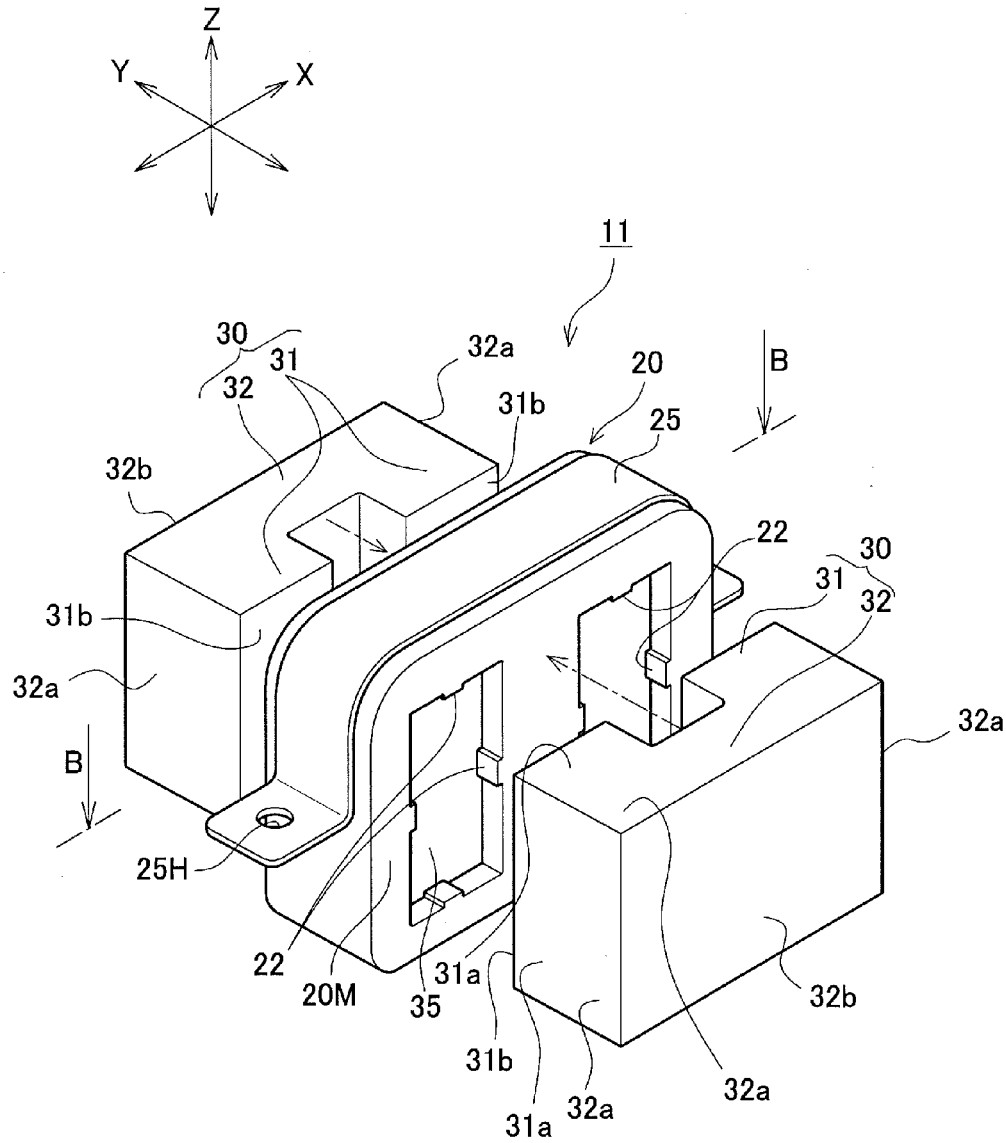
FIG. 5 is an exploded perspective view showing the reactor of Examples 1 and 2, showing a state where a magnetic-metal containing resin layer and a core protection layer are omitted.
Figure 6:
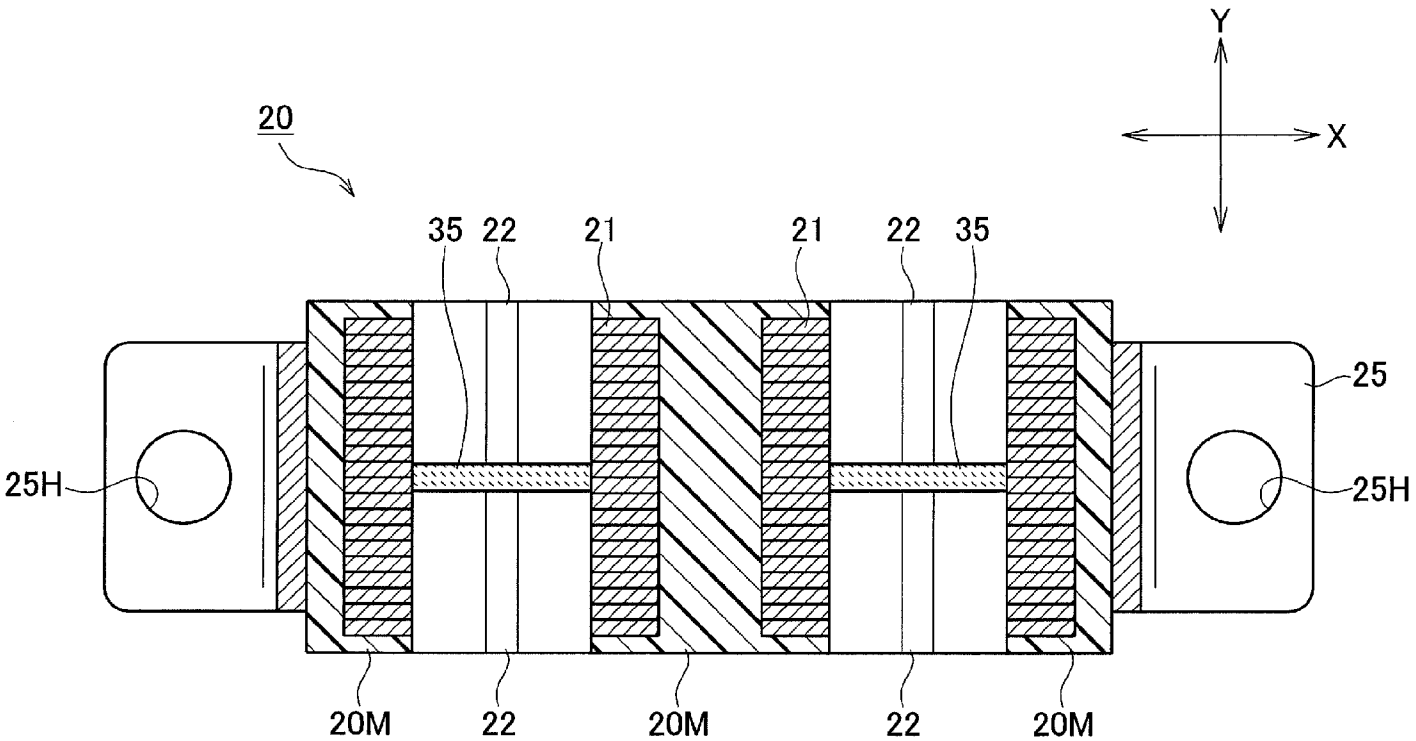
FIG. 6 is a cross sectional view of a molded coil of the reactor of Examples 1 and 2, taken along a line B-B in FIG. 5.

The reactor of the present example is explained below referring to FIGS. 1 to 6. FIG. 1 is a perspective view showing the reactor of the present example to explain mounting of the reactor on a cabinet. FIG. 2 is a cross sectional view taken along a line A-A in FIG. 1. FIG. 3 is a perspective view showing a main part of the reactor of the present example, showing a state where a molded layer is omitted. FIG. 4 is a plan view of the main part of the reactor shown in FIG. 3, seen from a Z direction, showing a state where a magnetic-metal containing resin is omitted. FIG. 5 is an exploded perspective view showing the reactor of the present example, showing a state where a magnetic-metal containing resin layer and a core protecting layer are omitted. FIG. 6 is a cross sectional view of a molded coil of the reactor of the present example, taken along a line B-B in FIG. 5.

In the present example, a X direction and a Z direction indicated in FIG. 1 are defined as a coil diameter direction and a Y direction is defined as a coil axial direction and a thickness direction of a molded coil. The X, Y, and Z directions indicated in FIG. 2 and subsequent figures correspond to the X, Y, and Z directions indicated in FIG. 1.

A reactor 10 of the present example is secured to a cabinet 60 for supporting the reactor 10 with bolts (fastening members) 50 as shown in FIG. 1. The cabinet 60 is made of metal, e.g., aluminum, by casting and includes a main part designed with a predetermined shape according to the mounting space for the reactor 10 and two fastened parts 61 each protruding toward a side apart from the main part (upward in the Z direction in FIG. 1). Each fastened part 61 is formed with a male screw engageable with the bolts 50.

The reactor 10 includes, as shown in FIGS. 1 and 2, a reactor main body 11, a reactor retainer 25, magnetic-metal containing resin layers 33, core protecting layers 34, and others. Furthermore, the main body 11 includes a molded coil 20, two cores 30 each having a U-like shape, and two gap elements 35.

The reactor main body 11 is first explained. The molded coil 20 is configured such that two coils 21 electrically connected in series are arranged in parallel, and these two coils 21 on their entire radial outside are integrally covered with a molded layer 20M made of epoxy resin or the like as shown in FIGS. 2 to 6. The molded coil 20 has a substantially hexahedral shape.

The molded coil 20 is arranged such that core insertion portions 31 of each core 30 which will be described later are inserted respectively in through holes of the coils 21 on their radial inside. The molded layer 20M is formed with protrusions 22 each protruding radially inward of the coils 21 to fix the core insertion portions 31 inserted in the coils 21. In the through holes of the molded coil 20, for example, the plate-like gap elements 35 each made of a non-magnetic material such as a ceramic plate having a thickness t of about 2 mm are placed at the center of the molded coil 20 in the thickness direction Y.

The molded coil 20 includes the reactor retainer 25 as a fastening-member retaining part to retain and fix the reactor 10 to the cabinet 60 with two bolts 50. As shown in FIGS. 1 and 6, the reactor retainer 25 is configured to fix the reactor 10 with a certain degree of spring force to the cabinet 60. To be concrete, the reactor retainer 25 is made of a metal plate having a spring characteristic bent like an angular U-shape, and each end portion of the bent parts is further folded at 90°. This reactor retainer 25 is provided at the center of the molded coil 20 in the thickness direction Y along the axial direction Y of the coils 21. The retainer 25 extends to stride on the molded coil 20 in the radial direction X of the coils 21. The retainer 25 has through holes 25H, 25H, each located outside the molded coil 20 covered by the retainer 25. The retainer 25 has one side surface subjected to for example undercutting, embossing, or other processing and is integral with the molded coil 20 by insert molding.

The reactor 10 is fixed to the cabinet 60 in a manner that two bolts 50 are inserted through the through holes 25H of the retainer 25 and screwed in the female screws of the fastened parts 61 of the cabinet 60.

The cores 30 will be explained below. In the present example, each core 30 is a powder core made in a manner that magnetic metal powder is compressed in an integral one piece. Herein, two cores 30 are provided, each having a U-like shape as shown in FIGS. 3 and 5. Each core 30 includes core insertion portions 31, 31 on both ends, and a core outer portion 32 joining, on the outside of the coils 21, the insertion portions 31 inserted individually in the coils 21 of the molded coil 20. Each core 30 is designed so that each of the insertion portions 31 and the outer portion 32 has a substantially rectangular cross section, the insertion portions 31 and the outer portion 32 have with the same height in the Z direction in FIGS. 3 and 5, and the cross sectional area of the outer portion 32 in the direction Y is smaller than the cross sectional area of each insertion portion 31 in the direction X. To be concrete, as shown in FIGS. 2 and 4, the core outer portion 32 has a second outer surface 32*b* extending along the X direction and first outer surfaces 32*a* extending in the Y direction, both surfaces forming a right angle. The thickness t2 of the core outer portion 32 in the Y direction is smaller than the thickness t1 of each core insertion portion 31 in the X direction. Specifically, the thickness t1 of each core insertion portion 31 is equal to the thickness s1 of each conventional core insertion portion 230A shown in FIG. 13, whereas the thickness t2 of the core outer portion 32 is smaller than the thickness s2 of the conventional core outer portion 230B.

Each core 30 is provided with magnetic-metal containing resin layers 33 on and in close contact with the first outer surfaces 32*a* of each core outer portion 32, located on coil ends 21E on both ends of each coil 21 in the coil axial direction Y and on the outside of the coils 21 in the coil axial direction Y as shown in FIGS. 1, 2, and 4. In other words, the resin layers 33 are placed in positions facing the coil ends 21E of each coil 21. These resin layers 33 are made of magnetic-metal containing resin consisting of binder resin and magnetic metal powder mixed therein.

The binder resin in the present example is epoxy resin. The metal powder is a powder made of for example, ferritic metal mainly containing Fe, metal such as Zn and Mn, Fe-base alloy such as Fe—C alloy and Fe—Si alloy, and others. The powder has a particle diameter of several μm to several tens of μm. The magnetic-metal containing resin contains such metal powder by as much as about 90% at a ratio by weight to epoxy resin.

On the second outer surface 32*b* of each core outer portion 32, a core protecting layer 34 is made of magnetic-metal containing resin. Each protecting layer 34 is continuous to the adjacent magnetic-metal containing resin layers 33 in each core 30 and has a smaller thickness than the magnetic-metal containing resin layer 33 and covers the second outer surface 32*b* in close contact therewith.

As with the core protecting layers 34, magnetic-metal containing resin covers first outer surfaces 31*a* of each core insertion portion 31, each being flush with corresponding the first outer surfaces 32*a* of the core outer portion 32, and second outer surfaces 31*b* continuous to the four first outer surfaces 31*a* and in contact with the gap elements 35. Meanwhile, in each core outer portion 32, when each first outer surface 32*a* and the second outer surface 32*b* form a right angle, such a configuration just as it is may be inherently insufficient in mechanical strength at each corner portion on those surfaces. In the reactor 10 of the present example, however, the magnetic-metal containing resin layers 33 are formed in close contact with the first outer surfaces 32*a* and the core protecting layers 34 are formed in close contact with the second outer surfaces 32*b*. Accordingly, the corner portions between the first outer surfaces 32*a* and the second outer surfaces 32*b* are not mechanically weak. Thus, damages such as cracking do not occur at the corner portions.

In the reactor 10 of the present example, a core (core assembly) consists of the two cores 30, each having the first and second outer surfaces 31*a* and 31*b* coated with magnetic-metal containing resin, coating layers made of the magnetic-metal containing resin layers 33, and the core protecting layers 34, and the two gap elements 35. The core insertion portions 31 of each core 30 are inserted in the coils 21 from one side in the coil axial direction Y so that the core insertion portions 31 of the opposite cores 30 face each other. These two cores 30 are joined in a track-like form while interposing the gap elements 35 therebetween.

In the present example, the two cores 30 and the gap elements 35 are fixed to each other in close contact manner by bonding using the binder resin, i.e., epoxy resin, contained in the magnetic-metal containing resin covering the second outer surfaces 31*b* of the core insertion portions 31 of the cores 30.

The following explanation is given to assembling of the reactor 10 and further fixing of the reactor 10 to the cabinet 60.

In assembling the reactor 10, the gap elements 35 are individually inserted in the through hole portions of the molded coil 20 and placed at the center in the thickness direction Y of the molded coil 20. The core insertion portions 31 of each core 30 are individually inserted in the coils 21 of the molded coil 20 from one sides of the coils 21 in the axial direction Y of the coils 21 so that the core insertion portions 31 of opposite cores face each other. The cores 30 are joined in a track-like form while interposing the gap elements 35 between them.

To be concrete, the core insertion portions 31 of one of the cores 30 are inserted in the radial inside of the coils 21 through two through hole portions located on one side of the molded coil 20. The second outer surfaces 31*b* of the inserted core insertion portions 31 are placed in close contact with one-side flat surfaces of the gap elements 35. This core 30 and the gap elements 35 are fixed to each other with the epoxy resin (binder resin) contained in the magnetic-metal containing resin covering the second outer surfaces 31*b*.

Similarly, the core insertion portions 31 of the other core 30 are inserted in the radial inside of the coils 21 through the two through hole portions located on the other side of the molded coil 20. The outer surfaces 31*b* of the inserted core insertion portions 31 are placed in close contact with the other-side flat surfaces of the gap elements 35. Then, this core 30 and the gap elements 35 are fixed to each other with the epoxy resin (binder resin) contained in the magnetic-metal containing resin covering the second outer surfaces 31*b*.

The four core insertion portions 31 inserted from both sides of the molded coil 20 are elastically held and fixed by the protrusions 22 of the molded layer 20M of the molded coil 20. Thus, the core insertion portions 31 are safely attached to the molded coil 20, particularly, even immediately after they are bonded to the gap elements 35. In the above way, the reactor main body 11 in a state with the molded resin omitted as shown in FIG. 3, that is, the reactor 10 is obtained in which the track-like cores 30 with the gap elements 35 interposed between them are inserted through the two coils 21 in the molded coil 20.

Then, this main body 11 in the state shown in FIG. 3 is set in a resin molding die, the magnetic-metal containing resin is injected in the die to fully cover the coils 21 and the core outer portions 32. Thus, the magnetic-metal containing resin layers 33 and the core protecting layers 34 are formed as shown in FIG. 1.

For fixing of the reactor 10 to the cabinet 60, subsequently, as shown in FIG. 1, the main part of the molded coil 20 (corresponding to a part in which the coils 21 and the gap elements 35 of the reactor main body 11 are located) of the reactor 10 is placed between the fastened parts 61 of the cabinet 60. Both end portions of the reactor retainer 25 are placed on the fastened parts 61. After this placement, the main part of the molded coil 20 of the reactor 10 is positioned apart from the cabinet 60 with a gap between the molded coil 20 and the cabinet 60. In this state, two bolts 50 are inserted through the through holes 25H of the reactor retainer 25 and screwed in the fastened parts 61, thereby securing the reactor retainer 25 to the fastened parts 61. In this way, the reactor 10 is fixed to the cabinet 60 with the two bolts 50.

Figure 7:
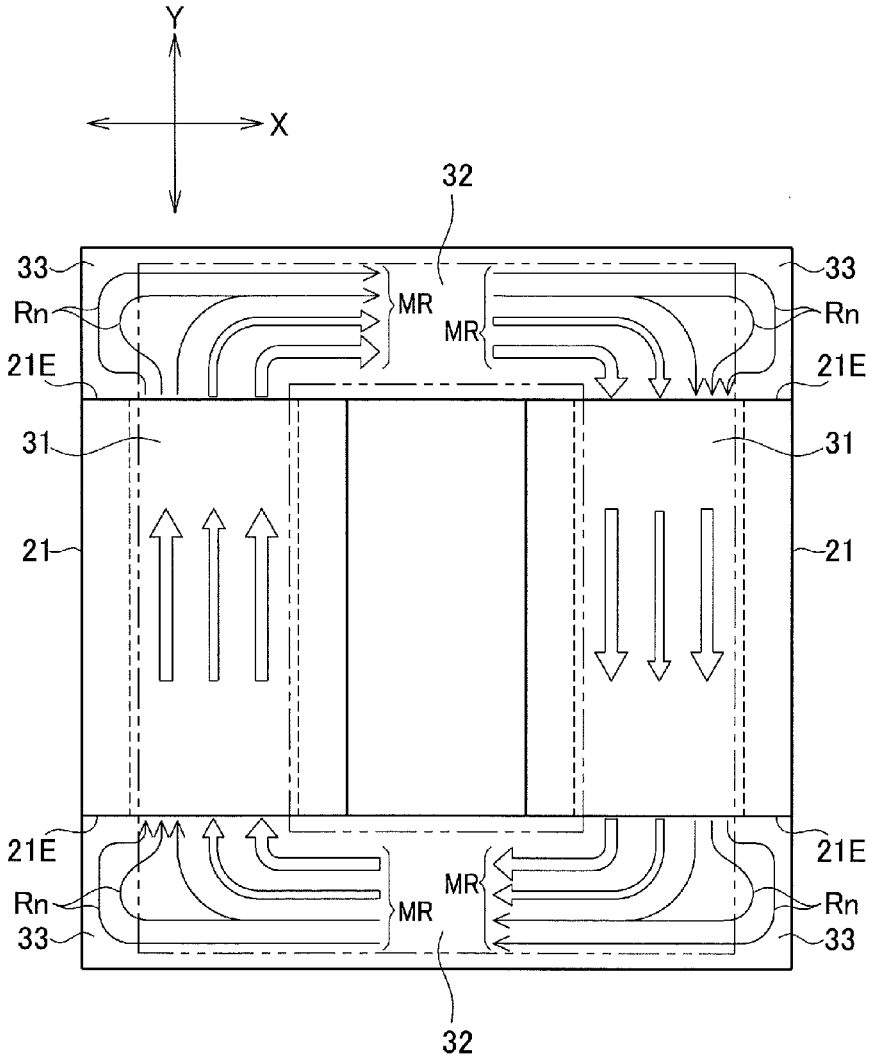
FIG. 7 is a conceptual view to explain a relationship between magnetic paths and magnetic saturation in a magnetic circuit of the reactor of Examples 1 and 2.
Figure 8:
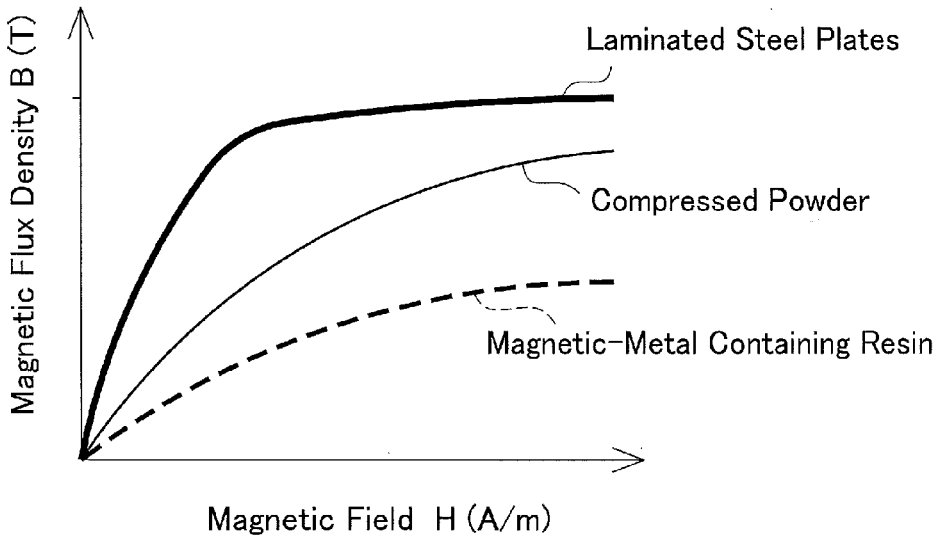
FIG. 8 is a graph showing a relationship between materials and B-H characteristic of cores and others.

The operations and advantageous effects of the reactor 10 of the present example having the above configuration will be explained below. FIG. 7 is a conceptual diagram to explain a relationship between magnetic paths and magnetic saturation in a magnetic circuit of the reactor of the present example. FIG. 8 is a graph showing a relationship between materials forming the cores and others and the B-H characteristics. The reactor 10 of the present example is configured as below. The molded coil 20 is formed in a substantially hexahedral shape. Each core 30 includes the core outer portion 32 joining both the core insertion portions 31 inserted in the coils 21, on the outside of the coils 21. The magnetic-metal containing resin layers 33 made of magnetic-metal containing resin consisting of binder resin (epoxy resin) and magnetic metal powder mixed therein are formed on the first outer surfaces 32*a* of the core outer portions 32. Accordingly, the magnetic field in the core insertion portions 31 of the cores 30 located on the radial inside of the coils 21 and the core outer portions 32 of the cores 30 located on the outside of the coils 21 can be utilized as a magnetic circuit. In addition, a magnetic field in portions ("coil-end adjacent portions") near the coil ends 21E of the coils 21 and adjacent to the coils 21 in the coil axial direction Y can be effectively utilized as the magnetic circuit as shown in FIG. 7 because of the presence of the magnetic-metal containing resin layers 33.

Specifically, the metal powder contained in the magnetic-metal containing resin is for example ferrite metal mainly containing Fe, metal such as Zn and Mn, or Fe-base alloy such as Fe—C alloy and Fe—Si alloy, and others. The powder has a particle diameter of several μm to several tens of μm. Such metal powder is contained in the magnetic-metal containing resin by as much as about 90% at a ratio by weight to epoxy resin. The magnetic-metal containing resin layers 33 made of the above magnetic-metal containing resin on the first outer surfaces 32*a* of the core outer portions 32 are inferior in magnetic permeability to the powder core, but can function as a core to form a magnetic circuit.

Herein, characteristics of a general reactor will be explained. A general reactor has a direct-current superimposing characteristic. Thus, if no gap element is provided in a core, large inductance is obtained when the direct current of a low current value flows in a coil, whereas when the current value is increased, the inductance abruptly lowers. As a result, magnetic saturation occurs at a low current value, so that the voltage cannot be increased to a desired voltage value. To avoid such a phenomenon, a gap element having a smaller magnetic permeability than cores is sandwiched between the cores. If the gap element is present, the inductance decreases at a lower current value as compared with the case where the gap element is absent, but a DC bias current value at which the inductance begins to decrease tends to be larger than the case where the gap element is absent. Specifically, differently from the case of the absence of the gap, the inductance remains at almost the same level from when the current value of current flowing in the coil is low to when it becomes high, and then the inductance gradually decreases. Therefore, a current value at which magnetic saturation occurs is also high. The magnetic saturation does not occur at a current value needed to increase the voltage to a desired voltage value.

For the reactor characteristics, when current flowing in a coil is increased, magnetic flux density also increases, so that the magnetic saturation occurs at the time when a magnetic field reaches a certain level of strength. In general, as the current value increases, the magnetic flux density is saturated in a manner that magnetic line paths MR are generated to be longer gradually from a short magnetic path (a thickest arrow) to a long magnetic path (a thinnest arrow) as shown in FIG. 7.

Figure 15:
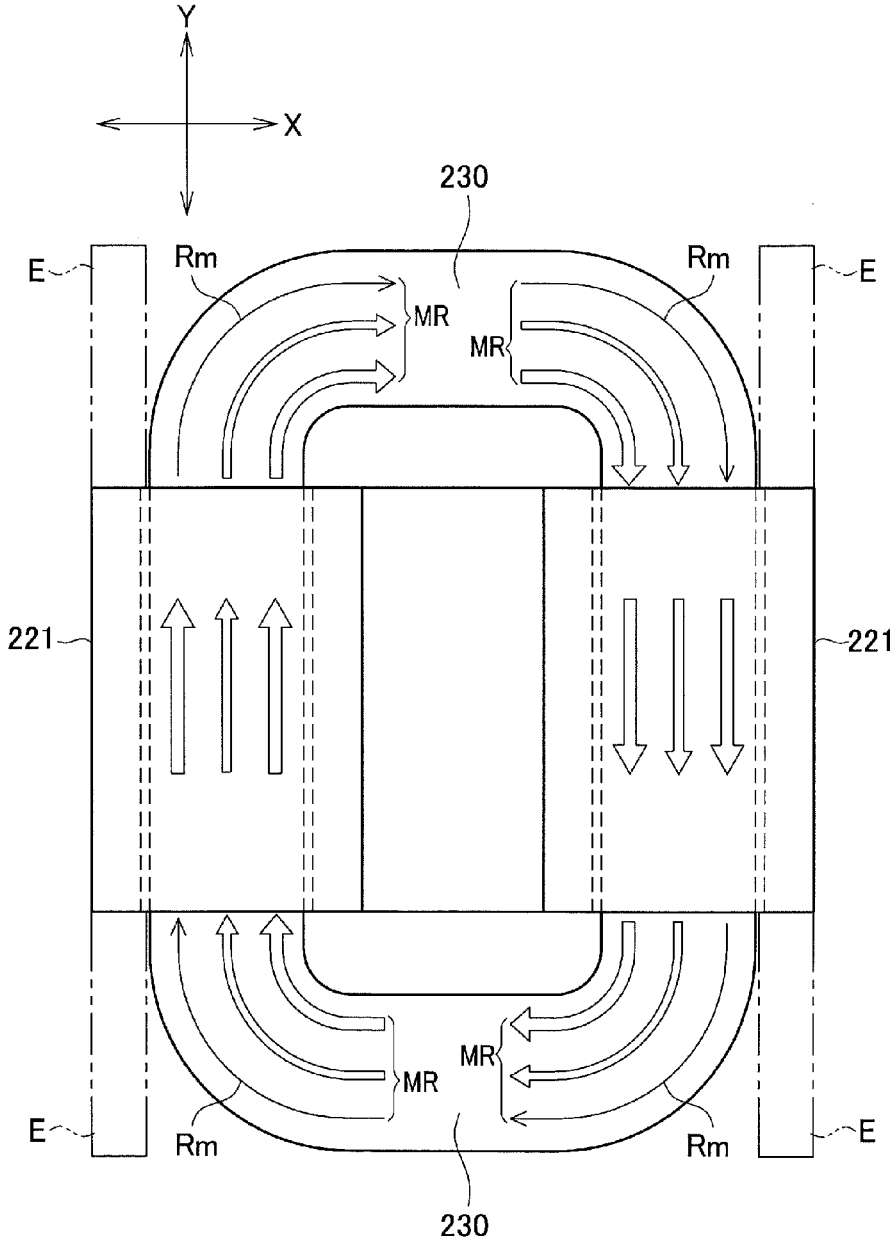
FIG. 15 is a schematic diagram showing magnetic paths of a magnetic circuit in the conventional reactor to explain a relationship between magnetic paths and magnetic saturation.

Herein, the magnetic circuit of the conventional reactor 210 and the magnetic circuit of the reactor 10 of the present example are compared by referring to FIGS. 7 and 15. In the core 230 of the conventional reactor 210, in which the coil-end adjacent portions E are dead space, the circumferential length (total length) is made longer and the cross sectional area is made larger to increase the entire volume of the cores 230, thereby ensuring long paths Rm of the magnetic paths MR.

In contrast, in the reactor 10 of the present example, even when the magnetic circuit is equal to the magnetic circuit of the conventional reactor 210 in terms of the characteristics, the longer paths (thinnest arrows) (long paths Rn) of the magnetic line paths MR are ensured throughout the magnetic-metal containing resin layers 33, instead of the long paths Rm of the magnetic paths MR shown in FIG. 15.

In the present example, specifically, the reactor 10 is mounted in a drive control system of a hybrid vehicle in order to increase the voltage of the system from a voltage value of a battery to a voltage value to be applied to a motor generator. In the reactor 10, the magnetic-metal containing resin layers 33 are formed on the first outer surfaces 32*a* of the core outer portions 32. Cores are roughly classified into a laminated-steel-plate core made of a plurality of laminated thin steel plates and a powder core made of magnetic metal powder compressed in an integral one piece. In the reactor 10 of the present example, the magnetic-metal containing resin layers 33 made of magnetic-metal containing resin are formed on the first outer surfaces 32*a* of the core outer portions 32 of the cores 30 which are the powder cores.

On the other hand, comparing in magnetic permeability between the laminated steel plates, the compressed powder, and the magnetic-metal containing resin, a mixture ratio of nonmagnetic material is higher in ascending order of the laminated steel plates, the compressed powder, and the magnetic-metal containing resin. The magnetic permeability is lower in descending order of the same. If the gap element having a smaller magnetic permeability than the core is not provided in the core, as mentioned above, magnetic saturation occurs at a low current value, so that voltage cannot be increased up to a desired voltage value.

Instead of the long paths Rm of the magnetic paths MR in the magnetic circuit of the conventional reactor 210, the longer paths Rn of the magnetic paths MR are ensured in the magnetic-metal containing resin layers 33 in the reactor 10 of the present example as shown in FIG. 7. The presence of the magnetic-metal containing resin layers 33 also helps the reactor 10 increase the voltage up to a desired voltage value before magnetic saturation occurs.

Accordingly, in the reactor 10, a current value at which the magnetic saturation occurs is high, and thus the magnetic saturation does not occur even at a current value needed to increase the voltage up to a desired high voltage value. Therefore, the reactor 10 is suitable for increasing voltage of a drive control system in a hybrid vehicle, an electric car, etc.

Figure 13:
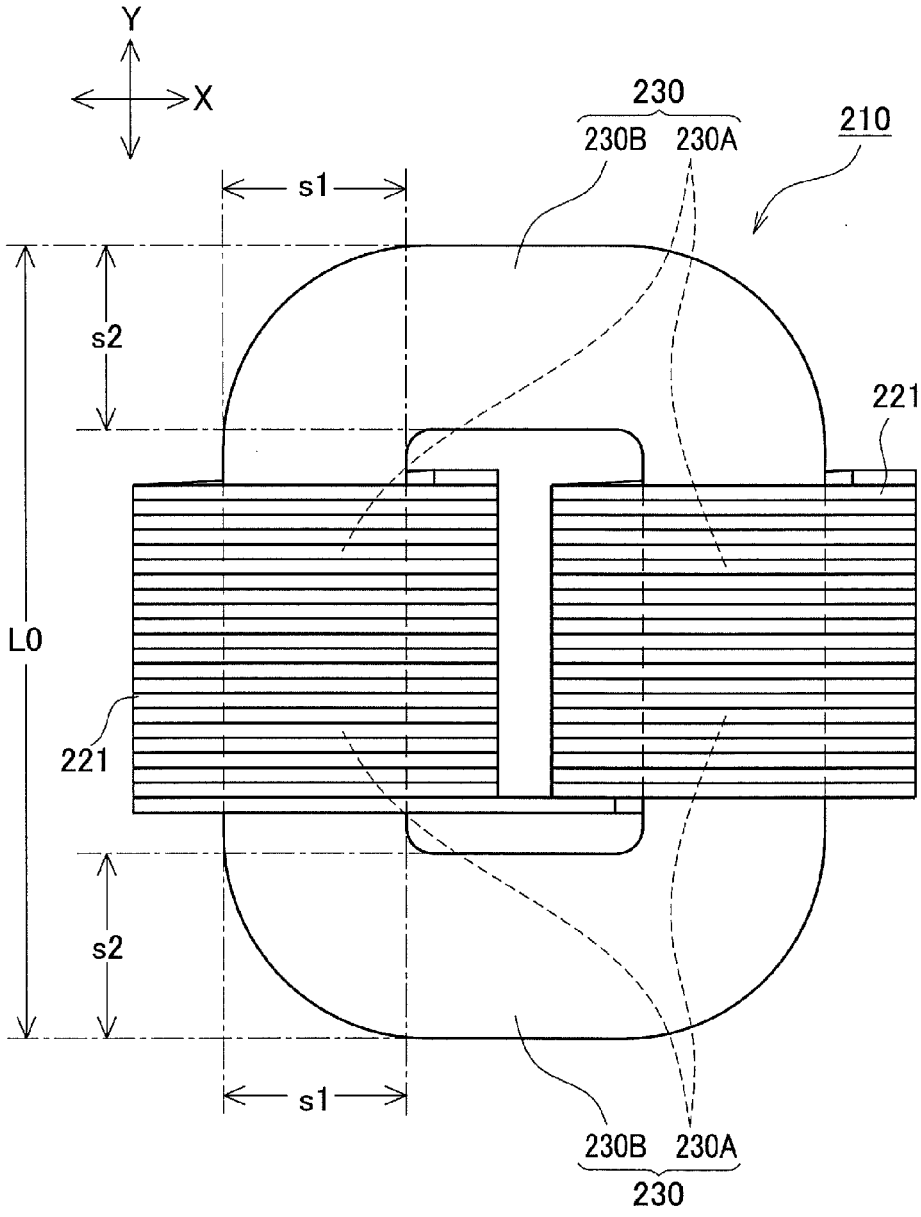
FIG. 13 is a plan view of FIG. 12 seen from a side C, schematically showing a main part of the reactor shown in FIG. 12.
Figure 14:
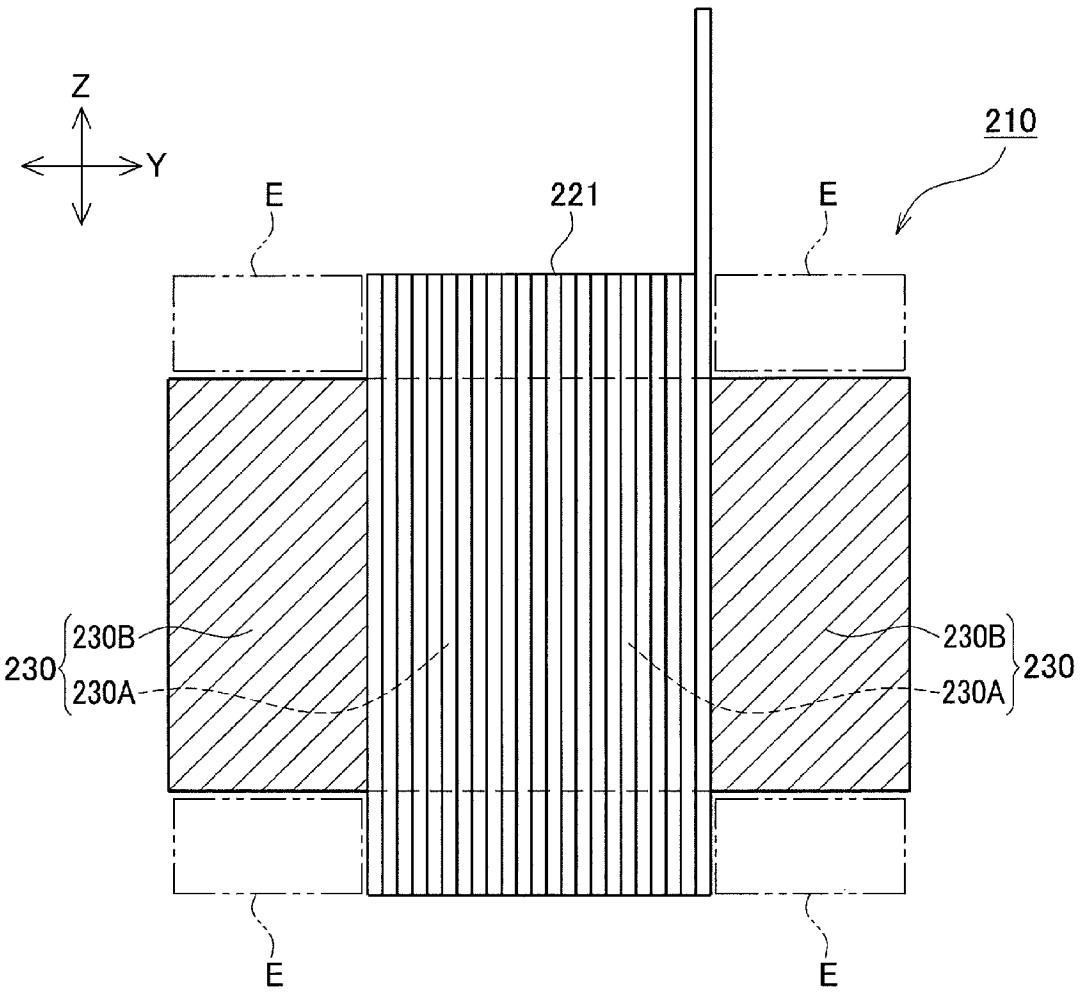
FIG. 14 is a side view of FIG. 12 seen from a side D, as with FIG. 13.

As above, during operation of the reactor 10, the magnetic-metal containing resin layers 33 are present in the magnetic field also generated in the coil-end adjacent portions corresponding to the coil-end adjacent portions E which would be dead space in the conventional reactor 210 as shown in FIGS. 14 and 15. Accordingly, the cores 30 as well as the magnetic-metal containing resin layers 33 formed on the first outer surfaces 32*a* of the core outer portions 32 can be efficiently utilized as the magnetic circuit. As well as the gap elements 35, a magnetic circuit corresponding to the volume equal to the conventional cores 230 is generated in the cores 30 and the magnetic-metal containing resin layers 33 of the present example as shown in FIGS. 13 and 14. Therefore, the cores 30 can be reduced in size than the conventional cores 230 by an amount substantially corresponding to the total volume of the magnetic-metal containing resin layers 33. Hence, the reactor 10 of the present example can be reduced in size than the conventional reactor 210 while keeping the performance of the conventional reactor 210.

In the reactor 10 of the present example, the magnetic-metal containing resin layers 33 are formed on the coil-end adjacent portions of the core outer portions 32, located on the coil ends 21E on both ends of each coil 21 in the coil axial direction Y and on the outside of the coils 21 in the axial direction Y of the coils 21. Thus, the magnetic-metal containing resin protects the first outer surfaces 32*a* of the core outer portions 32. In the cores 30, the occurrence of damages such as breaking and cracking is restrained in the core protecting layers 34 formed of magnetic-metal containing resin and the first outer surfaces 31*a* of the core insertion portions 31 covered with the magnetic-metal containing resin. In addition, rust prevention can be attained.

Furthermore, since the magnetic-metal containing resin layers 33 made of magnetic-metal containing resin are formed on the first outer surfaces 32*a* of the core outer portions 32, a core (core assembly) capable of effectively utilizing the magnetic field located in the coil-end adjacent portions as a part of the magnetic circuit can be achieved at lower costs owing to the cores 30 and the magnetic-metal containing resin layers 33, regardless of which the cores 30 are the laminated-steel-plate cores or the powder cores.

Figure 16:
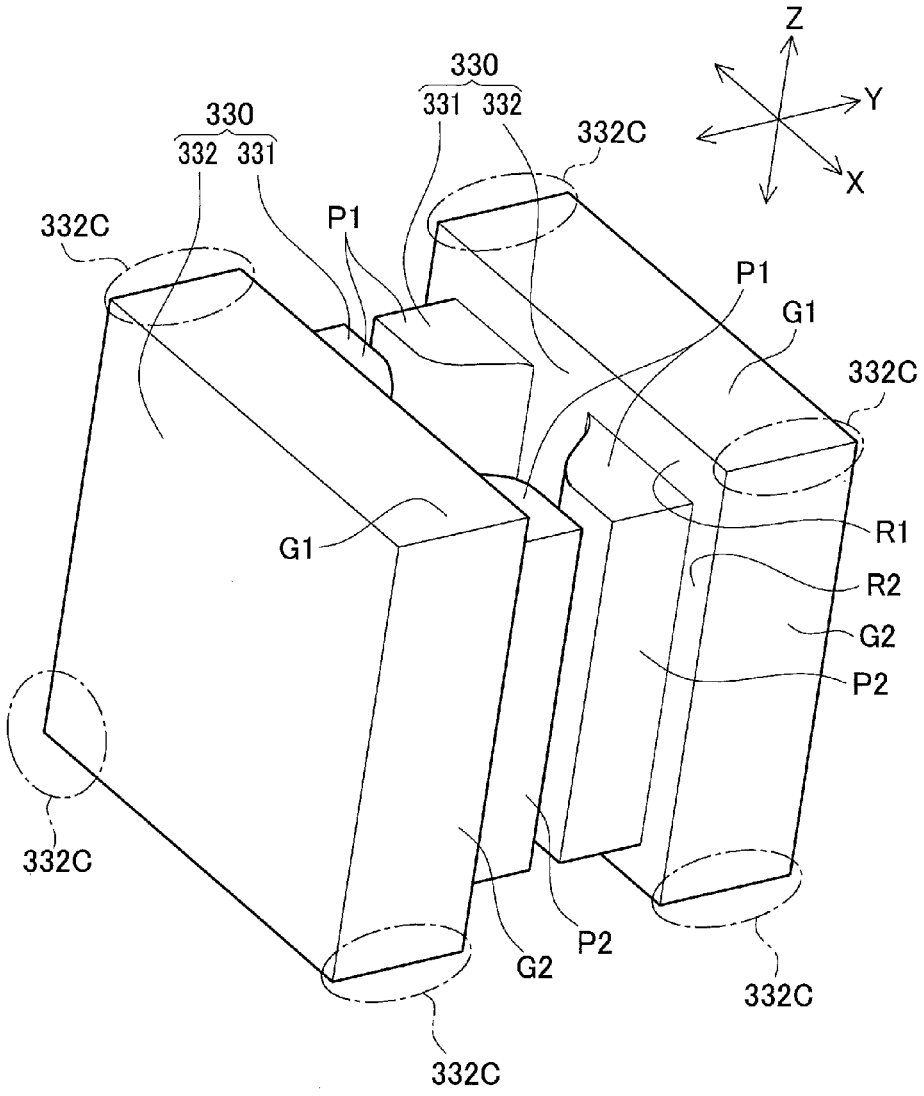
FIG. 16 is a perspective view showing a core of a reactor of a reference example studied for the case of a powder core.

In the case where the core is the laminated-steel-plate core, differently from the reactor 10 of the present example, it is conventionally considerably difficult in technique to produce a 3D-shaped core made of a plurality of laminated thin steel plates having steps between a core insertion portion and a core outer portion as shown in FIG. 16. This leads to high costs. A core utilizing a coil-end adjacent portion as a part of a magnetic circuit could not be easily attained.

In contrast, according to the reactor 10 of the present example, even if the cores 30 are the laminated-steel-plate cores, the cores can be manufactured in a similar manner to the manufacturing method of the conventional laminated-steel-plate cores and further the magnetic-metal containing resin layers 33 can be formed on steel plates constituting the cores 30 by known methods, for example, a fixing method using an adhesive material and a method of integrally forming magnetic-metal containing resin and a core by injection molding.

According to the reactor 10 of the present example, even when the cores 30 are the laminated-steel-plate cores, a core (core assembly) capable of effectively utilizing the magnetic field located in the coil-end adjacent portions as part of the magnetic circuit can be produced by the cores 30 and the magnetic-metal containing resin layers 33 at low costs.

On the other hand, in the case where the cores 30 are the powder cores, if the 3D-shaped core having the steps between the core insertion portions and the core outer portions as shown in FIG. 16 is manufactured by the forming method similar to the forming method of the conventional powder core, the core outer portions, particularly, the corner portions are apt to be lower in mechanical strength than a desired level. Furthermore, a study was also made on forming a core by using a special forming system to provide the desired mechanical strength to the corner portions. This rather results in a problem with high costs.

In contrast, in the reactor 10 of the present example, the cores 30 can be manufactured by the same forming method as the method of forming the conventional powder core. In addition, by for example a fixing method using an adhesive material, a method of integrally forming magnetic-metal containing resin and a core by injection molding, and other methods, the core outer portions 32 and the magnetic-metal containing resin layers 33 of the formed cores 30 can be provided in integrally close contact relation. Accordingly, the coil-end adjacent portions E which would be dead space in the conventional cores 230 can also be utilized easily as part of the magnetic circuit.

According to the reactor 10 of the present example, even when the cores 30 are the powder cores, a core capable of effectively utilizing the magnetic field located in the coil-end adjacent portion as a part of the magnetic circuit can be produced by the cores and the magnetic-metal containing resin layers at low costs.

In addition, even though the cores 30 are powder cores and the magnetic-metal containing resin layers 33 are formed in the coil-end adjacent portions, the cores 30 can be designed to be smaller than the conventional cores 230. Thus, the reactor 10 can be manufactured without causing cost increase.

According to the reactor 10 of the present example, each core 30 is configured such that the core insertion portions 31 and the core outer portion 32 are equal in height, while the cross sectional area of the core outer portion 32 is smaller than the cross sectional area of each core insertion portion 31. As shown in FIGS. 4 and 13, accordingly, the total length L of the reactor 10 in a direction along the coil axial direction Y can be shorter than the total length L0 of the conventional reactor 210 (L<L0). Thus, when the reactor 10 of the present example is manufactured to the same specifications in reactor performance as those of the conventional reactor 210, the reactor 10 can be made more compact than the conventional reactor 210. Therefore, the reactor 10 can be installed in a narrower space than conventional.

In particular, when the reactor 10 of the present example is mounted in a drive control system such as a hybrid vehicle, an electric car, or the like to increase the voltage of the system, the reactor 10 reduced in size is less restricted in space for installation. The reactors 10 having the same specifications can be mounted in many kinds of vehicles. This enables mass production of the reactors 10 of the present example having the same specifications, leading to low cost of the reactors 10.

In the reactor 10 of the present example, the binder resin of the magnetic-metal containing resin is epoxy resin. Since the epoxy resin has an adhesive property to join separate elements to each other, even if the metal powder is contained in the magnetic-metal containing resin by as much as about 90% at a ratio by weight, metal powder particles can be integrally bonded to each other through the binder resin.

When a large amount of metal powder can be contained in the magnetic-metal containing resin because the binder resin is epoxy resin, the metal powder has a high thermal conductivity and hence the entire magnetic-metal containing resin has a high thermal conductivity. During operation of the reactor 10, therefore, the heat generated in the coils 21 in the molded coil 20 is easy to transfer to the magnetic-metal containing resin having a high thermal conductivity and thus efficiently be released from the magnetic-metal containing resin to the outside.

In the reactor 10 of the present example, the magnetic-metal containing resin covers the first and second outer surfaces 31*a* and 31*b* of the core insertion portions 31 of each core 30. In the manufacturing process of the reactor 10, accordingly, when the cores 30 are joined to each other while the gap elements 35 are interposed between them, the epoxy resin contained in the magnetic-metal containing resin can be utilized as an adhesive to bond the cores 30 and the gap elements 35.

In the reactor, specifically, the two U-shaped cores are inserted in the coils from both sides of the coils to face each other and joined in a track-like form. In general, the gap elements having a lower magnetic permeability than the cores are interposed between the opposite core insertion portions.

In the manufacturing process of the conventional reactor 210, when the cores 230 are to be joined by interposing the gap elements 235 between them to form a core (core assembly), the cores 230 and the gap elements 235 are fixed to each other by additionally using an adhesive in a bonding step in a bonding oven. In the reactor 10 of the present example, in contrast, such a bonding oven is unnecessary and the gap elements 35 and the core insertion portions 31 of the cores 30 can be joined in close contact relation by the magnetic-metal containing resin covering the core insertion portions 31 of the cores 30.

When the magnetic-metal containing resin is to be formed on the core outer portions 32, the core insertion portions 31 are also covered by the magnetic-metal containing resin for protective measures of the core outer portions 32, the cores 30 entirely protected by the magnetic-metal containing resin can prevent the occurrence of damages such as breaking and cracking, and the occurrence of rust.

In addition, the above protective measures of the cores 30 can be implemented simultaneously when the magnetic-metal containing resin layers are formed on the first and second outer surfaces 32*a* and 32*b* of the core outer portions 32. Accordingly, the productivity for the protective measures of the cores 30 can be improved as compared with the conventional protective measures, resulting in reduced costs for the protective measures of the cores 30.

In the reactor 10 of the present example, the molded coil 20 includes the fastening-member retaining part 25 (the reactor retainer 25) to hold and fix the reactor 10 to the cabinet 60 to support the reactor 10 in combination with the bolts 50. Accordingly, even when the cores 30 are vibrated during operation of the reactor 10 and this vibration is transmitted to the molded coil 20 which is not a vibration source, transmission of the vibration can be reduced in the resin molded layer 20M of the molded coil 20.

When the state of current flowing in the coils 21 changes during operation of the reactor 10, the electromagnetic attraction force acting between the cores 30 depending on changes in magnetic flux density and the magnetostriction occurring in each core 30 are caused, thereby expanding and contracting both the cores 30, resulting in vibration of the cores 30.

In the reactor 10 of the present example, the molded coil 20 which is not a vibration source of such vibration is provided with the fastening-member retaining part 25. Accordingly, even when the vibration of the cores 30 is transmitted to the molded coil 20, the reactor 10 can be fixed to the cabinet 60 while vibration transmission is reduced in the molded layer 20M of the molded coil 20.

In the reactor 10 of the present example, the fastening-member retaining part 25 is provided at the center in the thickness direction of the molded coil 20 along the coil axial direction Y. The reactor 10 is held on the cabinet 60 by use of the retainer 25 provided in that position and fixed with the bolts 50. Accordingly, even if vibration of the cores 30 during operation of the reactor 10 is transmitted to the cabinet 60 through the molded coil 20 and the bolts 50, vibration to be transmitted to the cabinet 60 can be reduced.

During operation of the reactor, specifically, the cores expand and contract and thus vibrate as mentioned above. Cores are roughly classified into a laminated-steel-plate core made of a plurality of laminated thin steel plates and a powder core made of compressed powder. The powder core is lower in cost than the laminated-steel-plate core and therefore frequently used for cores.

On the other hand, comparing mechanical properties between the laminated-steel-plate core and the powder core, Young's modulus of the powder core is smaller than that of the laminated-steel-plate core and resonance frequency of the powder core is lower than that of the laminated-steel-plate core.

In the case where the core is the laminated-steel-plate core, the resonance frequency of the laminated-steel-plate core is different by several KHz or more from the drive frequency (about 10 KHz) at which the core vibrates during operation of the reactor. Thus, the core is less likely to largely vibrate under the influence of the resonance frequency.

In the case of the powder core, in contrast, the drive frequency of the core is close to the resonance frequency of the powder core and thus the core is likely to largely vibrate.

Irrespective of which the cores are the powder cores or the laminated-steel-plate cores, the vibration of the cores is mostly the vibration (axial vibration) of the cores repeatedly expanding and contracting in a direction to face each other. This vibration includes an "anti-node" representing a maximum amplitude and a "node" representing a minimum amplitude.

In the case where the cores are the powder cores, particularly, when the cores vibrate at the drive frequency close to the resonance frequency, the large vibration of the cores is transmitted to the cabinet fixed to the reactor with the fastening members at the position corresponding to the maximum amplitude, "anti-node". This causes noise resulting from the vibration of the cores.

In contrast, in the reactor 10 of the present example, the center in the thickness direction Y of the molded coil 20 becomes the position corresponding to the node of the vibration during axial vibration of the two cores 30. In this position, the magnetostriction and the amplitude of vibration by the electromagnetic attraction force in the two cores 30 are minimum.

In the case where the cores 30 are low-cost powder cores as in the present example, the vibration of the cores 30 has a minimum amplitude in the center in the thickness direction Y of the molded coil 20 even when the drive frequency of the cores 30 is close to the resonance frequency of the cores 30.

Therefore, the reactor 10 is fixedly held on the cabinet 60 by use of the bolts 50 and the fastening-member retaining part 25 placed in the center in the thickness direction Y of the molded coil 20. Even if the vibration is transmitted from the cores 30 to the cabinet 60 through the molded coil 20 and the bolts 50, the vibration of the cores 30 transmitted to the cabinet 60 can be reduced.

Furthermore, transmission of the vibration of the cores 30 occurring during operation of the reactor 10 can be reduced. Thus, noise resulting from the vibration can be more reliably restrained.

In the reactor 10 of the present example, the fastening-member retaining part 25 is the reactor retainer 25 formed to stride over the molded coil 20 in the radial direction X of the coils 21 and formed with the through holes 25H in positions outside the molded coil 20 covered with the retainer 25. The bolts 50 are inserted through the through holes 25H of the retainer 25 and secured to the cabinet 60. Accordingly, during operation of the reactor 10, it is possible to reduce the vibration to be transmitted from the cores 30 to the cabinet 60 via the retainer 25 and the bolts 50. This restrains loosening of the bolts 50 secured to the cabinet 60 which may be caused by the transmission of vibration. Thus, the reactor 10 can be tightly fixed to the cabinet 60 with stable fastening force for a long term.

In the reactor 10 of the present example, the reactor retainer 25 is made of metal and integral with the molded coil 20 by insert molding. Accordingly, the heat generated in the coils 21 located inside the molded coil 20 is easy to transfer to the reactor retainer 25 having a high thermal conductivity via the molded layer 20M of the molded coil 20. This heat can be thus released efficiently from the reactor retainer 25 to the outside.

EXAMPLE 2

Example 2 will be explained below referring to FIGS. 1, 2, and 4. In the reactor 10 of Example 1, the magnetic-metal containing resin layers 33 and the core protecting layers 34 are formed and also the first and second surfaces 31*a* and 31*b* of the core insertion portions 31 are covered with the magnetic-metal containing resin that contains epoxy resin as binder resin.

In the reactor 10 of the present example, on the other hand, the binder resin contained in the magnetic-metal containing resin is thermoplastic resin instead of epoxy resin. Example 2 is different in the material of binder resin from Example 1 but similar in other parts to Example 1. Accordingly, the following explanation is made with a focus on different parts from Example 1 with the same reference signs as those in Example 1, and the explanation of other parts is simplified or omitted.

In the present example, each core 30 is formed with magnetic-metal containing resin layers 33 on and in close contact with the first outer surfaces 32*a* of each core outer portion 32 located on the coil ends 21E on both ends of each coil 21 in the coil axial direction Y and on the outside of the coils 21 in the coil axial direction Y as shown in FIGS. 1, 2, and 4. Specifically, the magnetic-metal containing resin layers 33 are placed to face the coil ends 21E of each coil 21. The magnetic-metal containing resin layers 33 are made of magnetic-metal containing resin consisting of binder resin and magnetic metal powder mixed therein.

The second outer surfaces 32*b* of the core outer portions 32 are covered by the core protecting layers 34 made of magnetic-metal containing resin. The core protecting layers 34 are continuous to the adjacent magnetic-metal containing resin layers 33 in each core 30. The core protecting layers 34 are smaller in thickness than the magnetic-metal containing resin layers 33 and cover the second outer surfaces 32*b* in close contact relation. The first outer surfaces 31*a* of the core insertion portions 31 are also covered by magnetic-metal containing resin as with the core protecting layers 34.

The binder resin of the magnetic-metal containing resin in any part is thermoplastic resin. In the present example, it is polyphenylene sulfide (PPS). However, in the reactor 10 of the present example, the second outer surfaces 31*b* of the core insertion portions 31 of the cores 30 and the flat surfaces of the gap elements 35 are fixed to each other with an adhesive such as epoxy resin.

The operations and advantageous effects of the reactor 10 of the present example having the above configurations are explained below. In the reactor 10 of the present example, as in Example 1, the molded coil 20 is formed in an almost hexahedral shape. Each core 30 includes the core outer portion 32 joining, on the outside of the coils 21, both the core insertion portions 31 inserted in the coils 21. The magnetic-metal containing resin layers 33 made of magnetic-metal containing resin consisting of binder resin (PPS) and magnetic metal powder mixed therein are formed on the first outer surfaces 32*a* of the core outer portions 32. Accordingly, as shown in FIG. 7, the magnetic field in the core insertion portions 31 of the cores 30 located on the radial inside of the coils 21 and the magnetic field in the core outer portions 32 of the cores 30 located on the outside of the coils 21 can be utilized as the magnetic circuit. In addition, even the magnetic field located in the coil-end adjacent portions can also be effectively utilized as the magnetic circuit because of the presence of the magnetic-metal containing resin layers 33. Therefore, when the magnetic circuit corresponding to the volume equal to the conventional cores 230 as shown in FIGS. 13 and 14 is generated by the cores 30 and the magnetic-metal containing resin layers 33 as well as the gap elements 35 in the present example, the cores 30 can be reduced in size than the conventional cores 230 by an amount almost corresponding to the total volume of the magnetic-metal containing resin layers 33.

The reactor 10 is configured as above, in which the core insertion portions 31 on both sides of each core 30 are inserted in the coils 21 from one sides of the coils 21 in the coil axial direction Y so that the core insertion portions 31 of the opposite cores 30 face each other and are joined in a track-like form by interposing the gap elements 35 between them. Thus, this reactor 10 can provide a superior advantage of a reduced size than the conventional reactor 210 while keeping the performance of the conventional reactor 210.

In the reactor 10 of the present example, the binder resin of the magnetic-metal containing resin is PPS. Accordingly, a process of forming the magnetic-metal containing resin layers 33 on the first outer surfaces 32*a* of the core outer portions 31, a process of covering the core insertion portions 31 with the magnetic-metal containing resin, and other processes can be implemented at high cycles.

Therefore, the productivity associated with forming the magnetic-metal containing resin layers 33 and covering the core insertion portions 31 with the magnetic-metal containing resin can be enhanced. This can reduce the cost of the reactor 10 of the present example.

It is to be noted that the thermoplastic resin may include polyphenylene sulfide (PPS), polyamide resin which is a material forming nylon, polyamide, etc., and the like.

The present invention is explained above in Examples 1 and 2 but not limited thereto. The present invention may be embodied in other specific forms without departing from the essential characteristics thereof. For instance, the cores 30 in Examples 1 and 2 are powder cores, but may be laminated-steel-plate cores each made of a plurality of laminated thin steel plates.

INDUSTRIAL APPLICABILITY

According to the present invention, as is clear from the above explanation, the reactor can be provided with a reduced size than the conventional reactor while the cores are protected and the performance is maintained.

REFERENCE SIGNS LIST

10 Reactor
20 Molded coil
21 Coil
21E Coil end
25 Reactor retainer
25H Through hole
30 Core
31 Core insertion portion
32 Core outer portion
32*a* First outer surface (Outer surface)
33 Magnetic-metal containing resin layer
50 Bolt (Fastening member)
60 Cabinet
X, Z Coil radial direction
Y Coil axial direction, Thickness direction of Molded coil

The invention claimed is:

1. A reactor including:

a molded coil in which two coils electrically connected in series are arranged in parallel and integrally molded with resin covering a radial outside of the coils; and two U-shaped cores each having core insertion portions on both sides, the core insertion portions of the cores being inserted in the coils from either sides of the coils in a coil axial direction to face each other, and the cores being joined in a track-like form by interposing gap elements between them to form a core assembly, wherein the molded coil has a substantially hexahedral shape, each of the cores includes a core outer portion joining, outside the coils, both the core insertion portions inserted in the coils, a magnetic-metal containing resin layer made of magnetic-metal containing resin consisting of binder resin and magnetic metal powder mixed therein is formed on outer surfaces of the core outer portions, the molded coil includes a fastening retaining part for holding and fixing the reactor to a cabinet with a fastening member so that the cabinet supports the reactor, the fastening retaining part is made of metal plate having a spring characteristic bent in an angular-U-shape, and each end portion of the bent parts is further folded at 90° outside, the molded coil is held apart from the cabinet by the fastening member and the fastening-member retaining part, and the gap elements are placed inside U-like shape of each of the U-shaped cores wherein the fastening retaining part is provided at a center of the molded coil in a thickness direction along the coil axial direction of the coils, and wherein the fastening retaining part extends to stride on the molded coil in a radial direction of the coils.

2. The reactor according to claim 1, wherein the magnetic-metal containing resin layer is formed at least on a part of each core outer portion in a position on coil ends of each coil located on both ends in the coil axial direction, the position located on the outside of each of the coils in a coil axial direction.

3. The reactor according to claim 1, wherein each core is designed so that the core insertion portions and the core outer portion are formed with the same height, while a cross sectional area of the core outer portion in a coil radial direction is smaller than a cross sectional area of each core insertion portion in the coil axial direction.

4. The reactor according to claim 1, wherein the binder resin of the magnetic-metal containing resin is epoxy resin.

5. The reactor according to claim 4, wherein the magnetic-metal containing resin covers the core insertion portions of each core.

6. The reactor according to claim 1, wherein the binder resin of the magnetic-metal containing resin is thermoplastic resin.

7. The reactor according to claim 1, wherein the fastening-member retaining part is provided at the center in a thickness direction of the molded coil in the coil axial direction.

8. The reactor according to claim 7, wherein the fastening-member retaining part is a reactor retainer extending to stride over the molded coil in a coil radial direction and including a through hole in a position outside of the covered molded coil, and the fastening member is inserted through the through hole of the reactor retainer and secured to the cabinet.

9. The reactor according to claim 8, wherein the reactor retainer is made of metal and integral with the molded coil by insert molding.

10. The reactor according to claim 2, wherein each core is designed so that the core insertion portions and the core outer portion are formed with the same height, while a cross sectional area of the core outer portion in the coil radial direction is smaller than a cross sectional area of each core insertion portion in the coil axial direction.

11. The reactor according to claim 2, wherein the binder resin of the magnetic-metal containing resin is epoxy resin.

12. The reactor according to claim 3, wherein the binder resin of the magnetic-metal containing resin is epoxy resin.

13. The reactor according to claim 2, wherein the binder resin of the magnetic-metal containing resin is thermoplastic resin.

14. The reactor according to claim 3, wherein the binder resin of the magnetic-metal containing resin is thermoplastic resin.

15. The reactor according to claim 10, wherein the binder resin of the magnetic-metal containing resin is thermoplastic resin.

* * * * *